US010883333B2

(12) United States Patent
Giroux et al.

(10) Patent No.: US 10,883,333 B2
(45) Date of Patent: Jan. 5, 2021

(54) BUOYANT SYSTEM FOR INSTALLING A CASING STRING

(71) Applicant: Weatherford Technology Holdings, LLC, Houston, TX (US)

(72) Inventors: Richard Lee Giroux, Bellville, TX (US); Jobby T. Jacob, Sugar Land, TX (US); Jeffery Morrison, Missouri City, TX (US); Joshua Vernon Symms, Cypress, TX (US); Luis A. Urdaneta, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 16/408,742

(22) Filed: May 10, 2019

(65) Prior Publication Data

US 2019/0352995 A1 Nov. 21, 2019

Related U.S. Application Data

(63) Continuation-in-part of application No. 15/982,151, filed on May 17, 2018.

(51) Int. Cl.
*E21B 33/12* (2006.01)
*E21B 47/06* (2012.01)
(Continued)

(52) U.S. Cl.
CPC ..... *E21B 33/1208* (2013.01); *E21B 29/02* (2013.01); *E21B 34/063* (2013.01); *E21B 47/06* (2013.01); *E21B 43/10* (2013.01)

(58) Field of Classification Search
CPC .... E21B 33/1208; E21B 34/063; E21B 17/08; E21B 34/14
See application file for complete search history.

(56) References Cited

U.S. PATENT DOCUMENTS 1,884,165 A 10/1932 Otis
2,560,901 A 7/1951 Smith
(Continued)

FOREIGN PATENT DOCUMENTS

WO 2009116871 A1 9/2009
WO 2016046533 A1 3/2016
(Continued)

OTHER PUBLICATIONS

Giroux et al.; Buoyant System for Installing a Casing String; U.S. Appl. No. 15/982,151, filed May 17, 2018, (Application not attached to IDS).

(Continued)

*Primary Examiner* — Robert E Fuller
*Assistant Examiner* — Theodore N Yao
(74) *Attorney, Agent, or Firm* — Patterson + Sheridan, LLP

(57) ABSTRACT

A sealing device includes a tubular body having a bore; a collet seat having a plurality of collets; a frangible sealing element disposed in the collet seat and blocking fluid communication through the bore; and a releasable sleeve releasably attached to the tubular body and retaining the collet seat against the tubular body. In one embodiment, the plurality of the collets includes threads mated with threads on the tubular body. In another embodiment, the plurality of the collets is attached to the sleeve.

20 Claims, 15 Drawing Sheets

(51) Int. Cl.

| | |
|---|---|
| ***E21B 29/02*** | (2006.01) |
| ***E21B 34/06*** | (2006.01) |
| ***E21B 43/10*** | (2006.01) |

(56) References Cited

U.S. PATENT DOCUMENTS

| | | | | |
|---|---|---|---|---|
| 2,565,731 | A | 8/1951 | Johnston | |
| 3,445,032 | A | 5/1969 | Raidl, Jr. et al. | |
| 3,620,799 | A | 11/1971 | Hoelscher et al. | |
| 3,831,680 | A * | 8/1974 | Edwards | E21B 21/10 166/311 |
| 4,602,731 | A | 7/1986 | Dockus | |
| 4,658,902 | A | 4/1987 | Wesson et al. | |
| 4,911,987 | A | 3/1990 | Sakata et al. | |
| 5,082,739 | A | 1/1992 | Roy et al. | |
| 5,479,986 | A | 1/1996 | Gano et al. | |
| 5,607,017 | A | 3/1997 | Owens et al. | |
| 5,685,372 | A | 11/1997 | Gano | |
| 5,765,641 | A | 6/1998 | Shy et al. | |
| 5,924,696 | A | 7/1999 | Frazier | |
| 5,947,204 | A | 9/1999 | Barton | |
| 6,026,903 | A | 2/2000 | Shy et al. | |
| 6,076,600 | A | 6/2000 | Vick, Jr. et al. | |
| 6,182,704 | B1 | 2/2001 | Bevacco | |
| 6,472,068 | B1 | 10/2002 | Glass et al. | |
| 7,513,311 | B2 | 4/2009 | Gramstad et al. | |
| 7,665,528 | B2 | 2/2010 | Ross et al. | |
| 7,699,113 | B2 | 4/2010 | Ring | |
| 7,712,521 | B2 | 5/2010 | Sorensen | |
| 7,806,189 | B2 | 10/2010 | Frazier | |
| 7,909,104 | B2 | 3/2011 | Bjorgum | |
| 7,963,340 | B2 | 6/2011 | Gramstad et al. | |
| 8,322,448 | B2 * | 12/2012 | Brandsdal | E21B 33/12 166/376 |
| 8,397,813 | B2 | 3/2013 | Brandsdal | |
| 8,813,848 | B2 | 8/2014 | Frazier | |
| 9,194,209 | B2 | 11/2015 | Frazier | |
| 9,222,322 | B2 | 12/2015 | Brandsdal | |
| 9,291,031 | B2 | 3/2016 | Frazier | |
| 9,353,596 | B2 | 5/2016 | Raggio | |
| 9,382,778 | B2 | 7/2016 | Frazier | |
| 9,464,497 | B2 | 10/2016 | Kekarainen | |
| 9,593,542 | B2 | 3/2017 | Getzlaf et al. | |
| 9,657,547 | B2 | 5/2017 | Raggio | |
| 9,708,884 | B2 | 7/2017 | Epstein | |
| 9,732,579 | B2 * | 8/2017 | Hiorth | E21B 33/1208 |
| 9,739,114 | B2 | 8/2017 | Frazier | |
| 10,000,991 | B2 * | 6/2018 | Harris | E21B 33/1291 |
| 10,465,468 | B2 * | 11/2019 | Frazier | E21B 33/1293 |
| 2003/0168214 | A1 | 9/2003 | Sollesnes | |
| 2011/0284242 | A1 | 11/2011 | Frazier | |
| 2013/0228338 | A1 | 9/2013 | Brandsdal | |
| 2014/0008085 | A1 * | 1/2014 | Tinnen | E21B 29/00 166/387 |
| 2014/0216756 | A1 | 8/2014 | Getzlaf et al. | |
| 2015/0068730 | A1 * | 3/2015 | Frazier | E21B 34/063 166/181 |
| 2015/0211321 | A1 | 7/2015 | Wee | |
| 2016/0281455 | A1 | 9/2016 | Brandsdal et al. | |
| 2016/0369582 | A1 * | 12/2016 | Bar | E21B 23/01 |
| 2017/0022783 | A1 * | 1/2017 | Yong | E21B 34/063 |
| 2017/0096875 | A1 * | 4/2017 | Ravensbergen | E21B 17/00 |
| 2018/0347323 | A1 * | 12/2018 | Kohn | E21B 23/00 |
| 2018/0371869 | A1 * | 12/2018 | Kellner | E21B 21/103 |
| 2019/0153816 | A1 * | 5/2019 | Campbell | E21B 34/10 |

FOREIGN PATENT DOCUMENTS

| | | | |
|---|---|---|---|
| WO | 2016195508 | A1 | 12/2016 |
| WO | 2017034416 | A1 | 3/2017 |

OTHER PUBLICATIONS

Fike Corporation, Fike Pad (Pressure Activation Device), Form No. OTB 20320799 Brochure, Copyright 1999. (2 total pages).

Fike Corporation, Well Test Membrane, Form No. OTB 20310599 Brochure, Copyright 1999. (2 total pages).

Magnum Oil Tools: Single Inverventionless Magnumdisk Brochure; Copyright 2015 (Rev-Feb. 9, 2016) (2 pages total).

Magnum Oil Tools: Magnum's Single Magnum Disk Frangible Knockout Isolation Sub Brochure (2 pages total).

U.S. Pat. No. 7,806,189, Frazier, Oct. 5, 2010.

Non-Final OA in U.S. Appl. No. 15/982,151 dated Sep. 17, 2019.

Final Office Action in U.S. Appl. No. 15/982,151 dated May 23, 2019.

Non-Final OA in U.S. Appl. No. 15/982,151 dated Feb. 27, 2019.

* cited by examiner

BUOYANT SYSTEM FOR INSTALLING A CASING STRING

CROSS-REFERENCE TO RELATED APPLICATIONS

This application is a continuation-in-part of U.S. patent application Ser. No. 15/982,151, filed on May 17, 2018, which application is incorporated herein by reference in its entirety.

BACKGROUND

Field

Embodiments of the present disclosure generally relate to running a casing string into a wellbore.

Description of the Related Art

In extended reach wells or wells with complex trajectory, operators often experience difficulty in running a liner/casing past a certain depth or reach. The depth or reach of the liner is typically limited by the drag forces exerted on the liner. If further downward force is applied, the liner may be pushed into the sidewall of the wellbore and become stuck or threaded connections in the liner may be negatively impacted. As a result, the liners are prematurely set in the wellbore, thereby causing hole downsizing.

Various methods have been developed to improve liner running abilities. For example, special low friction centralizers or special fluid additives may be used to reduce effective friction coefficient. In another example, floating a liner against the wellbore may be used to increase buoyancy of the liner, thereby reducing contact forces.

There is a need, therefore, for apparatus and methods to improve tubular running operations.

SUMMARY

In one embodiment, a sealing device includes a tubular body having a bore; a collet seat having a plurality of collets; a frangible sealing element disposed in the collet seat and blocking fluid communication through the bore; and a releasable sleeve releasably attached to the tubular body and retaining the collet seat against the tubular body.

In another embodiment, a sealing device includes a tubular body having a bore; a frangible sealing element disposed in the tubular body and blocking fluid communication through the bore; an aperture formed in the sealing element; and a rupture device selectively blocking fluid communication through the aperture.

In another embodiment, a tubular assembly disposed in a wellbore, includes a tubular string having a bore; a sealing device as described herein disposed in the tubular string and blocking fluid flow through the bore; a valve assembly disposed in the tubular string and downstream from the sealing device, the valve assembly blocking fluid flow through the bore; a buoyant chamber formed between the sealing device and the valve assembly, the buoyant chamber including a fluid having a lower specific gravity than a fluid in the wellbore.

In another embodiment, a tubular assembly disposed in a wellbore includes a tubular string having a bore; a lower sealing device disposed in the tubular string and blocking fluid flow through the bore; an upper sealing device disposed in the tubular string and located upstream from the lower sealing device, the upper sealing device blocking fluid flow through the bore.

In one embodiment, the upper sealing device includes a tubular body having a bore; a frangible sealing element disposed in the tubular body and blocking fluid communication through the bore of the tubular body, the sealing element includes a dome having a concave surface oriented toward the lower sealing device; and a buoyant chamber formed between the lower sealing device and a upper sealing device, the buoyant chamber including a fluid having a lower specific gravity than a fluid in the wellbore.

In another embodiment, a method of installing a tubular string in a wellbore includes forming a buoyant chamber between a sealing device and a valve assembly disposed in the tubular string. The sealing device includes a tubular body having a bore; a frangible sealing element disposed in the tubular body and blocking fluid communication through the bore of the tubular body, the sealing element includes a dome and an aperture formed through the dome; and an aperture formed through the dome, the aperture blocked from fluid communication. The method also includes supplying the buoyant chamber with a fluid having a lower specific gravity than a fluid in the wellbore; moving the tubular string along the wellbore; applying pressure to open the aperture for fluid communication; and flowing fluid through the aperture to break the sealing element.

In another embodiment, a sealing device includes a tubular body having a bore; a collet seat having a plurality of collets; a frangible sealing element disposed in the collet seat and blocking fluid communication through the bore; and a releasable sleeve releasably attached to the tubular body, wherein the plurality of collets is attached to the sleeve.

In another embodiment, a sealing device includes a tubular body having a bore; a support frame attached to the tubular body; a sealing element disposed on the support frame and blocking fluid communication through the bore; and a sensor configured to detect a pressure exterior of the sealing element, wherein the support frame is configured to collapse in response to the sensor detecting a predetermined pressure or pressure pulse.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

FIG. 2 also illustrates an exemplary embodiment of a lower sealing device.

DETAILED DESCRIPTION

Figure 1:
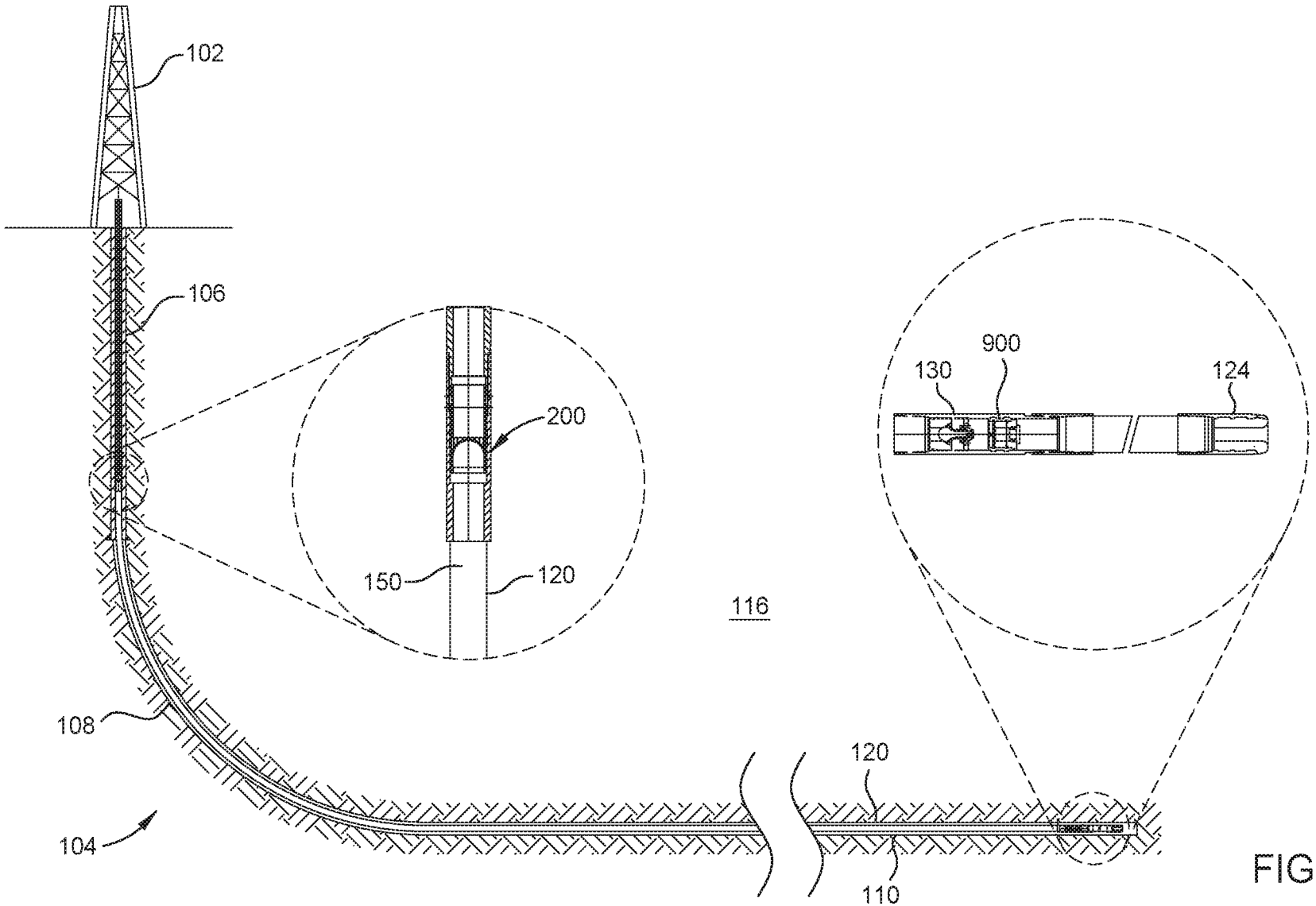
FIG. 1 is a schematic view of a wellbore having a casing string equipped with a sealing device and a valve assembly, according to some embodiments.

FIG. 1 is a schematic side view of a wellbore 104. A drilling rig 102 on the surface has been used to drill a wellbore 104 into the earth 116. The wellbore 104 includes a vertical section 106. Thereafter, a drill bit may be maneuvered to form a diverging section 108 of the wellbore 104. The drill bit may be maneuvered to ultimately form a horizontal section 110 of the wellbore 104. Such horizontal wellbores 110 can enable a single drilling rig 102 to access a relatively large region of a particular geological formation at the depth of the horizontal section 110 of the wellbore 104.

After the wellbore or a portion of the wellbore 104 has been drilled, a casing string is typically installed. The casing string is typically made up of a series of metal pipes (i.e., casing sections) that are connected together end to end. After the casing string has been placed in the wellbore, cement is pumped through the casing string to a distal end of the casing string. From there, the cement can flow back toward the surface of the well through an annular gap between the wellbore and the casing string. The cement cures to seal the annular gap.

Figure 2:
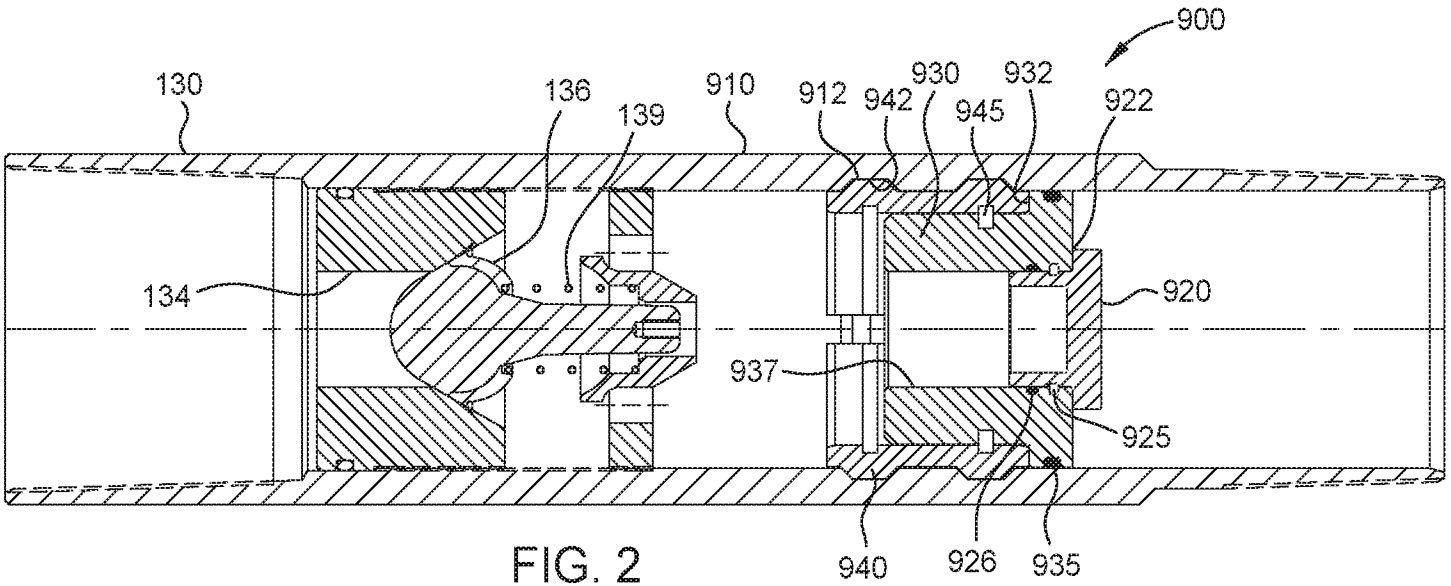
FIG. 2 illustrates an exemplary embodiment of a valve assembly of FIG. 1.

The distal end of the casing string 120 includes a shoe 124 attached to the distal end of the casing string 120. The shoe 124 may have a tapered exterior surface that can guide the distal end of the casing string 120 through the wellbore 104. The shoe 124 includes an aperture in fluid communication with the bore of the casing string 120. In various aspects, the shoe 124 can have multiple apertures therethrough. A valve assembly 130 arranged in the casing string 120 is spaced apart from the distal end of the casing string 120. The valve assembly 130 includes a passageway 134 in fluid communication with the bore of the casing string 120, as shown in FIG. 2. The ends of the valve assembly 130 are connectable to the casing string 120, such as via threads. A valve 136 can be arranged in the passageway to control fluid communication through the passageway 134. The valve 136 can include a biasing mechanism 139, such as a spring, that urges the valve 136 into a closed position. The passageway 134 and the valve 136 can be made of a composite material (e.g., a plastic material, a composite material, or a fiber reinforced composite material). A fluid, such as cement or drilling fluid can be pumped through the casing string 120 to overcome the biasing force of the biasing mechanism to move the valve to an open position. In one embodiment, any or all of the components of the valve assembly 130 can be made of a dissolvable material, such as an aluminum-based alloy. In another embodiment, the valve assembly 130 can include a mixture of aluminum-based alloy components and composite based components.

Due to the weight of the casing string 120, the distal end of the casing string 120 is resting on a wall surface of the diverging section 108 and/or the horizontal section 110 of the wellbore 104 during the run-in. As the distal end of the casing string 120 is translating through the horizontal section 110 of the wellbore 104, friction between the casing string 120 and the bottom surface of the horizontal section 110 can make it difficult for the casing string 120 to reach its target location.

In various embodiments described herein, the casing string 120 is equipped with a buoyant system to reduce the weight of the casing string 120 resting on the bottom surface of the wellbore.

In one embodiment, the buoyant system includes a buoyant chamber 150 formed in the casing string 120 to facilitate positioning of the casing string 120 in the wellbore 104. The chamber 150 is formed between the valve assembly 130 in the closed position and a sealing device 200 positioned upstream from the valve assembly 130. As shown in FIG. 1, the sealing device 200 is positioned in a vertical section 106 of the casing string 120. However, it is contemplated the sealing device 200 may be positioned in the diverging section 108 or horizontal section 110. The sealing device 200 is configured to prevent fluid communication in the casing bore across the sealing device 200. The distance between the sealing device 200 and the valve assembly 130 can be selected based on the desired amount of buoyance.

Figure 3:
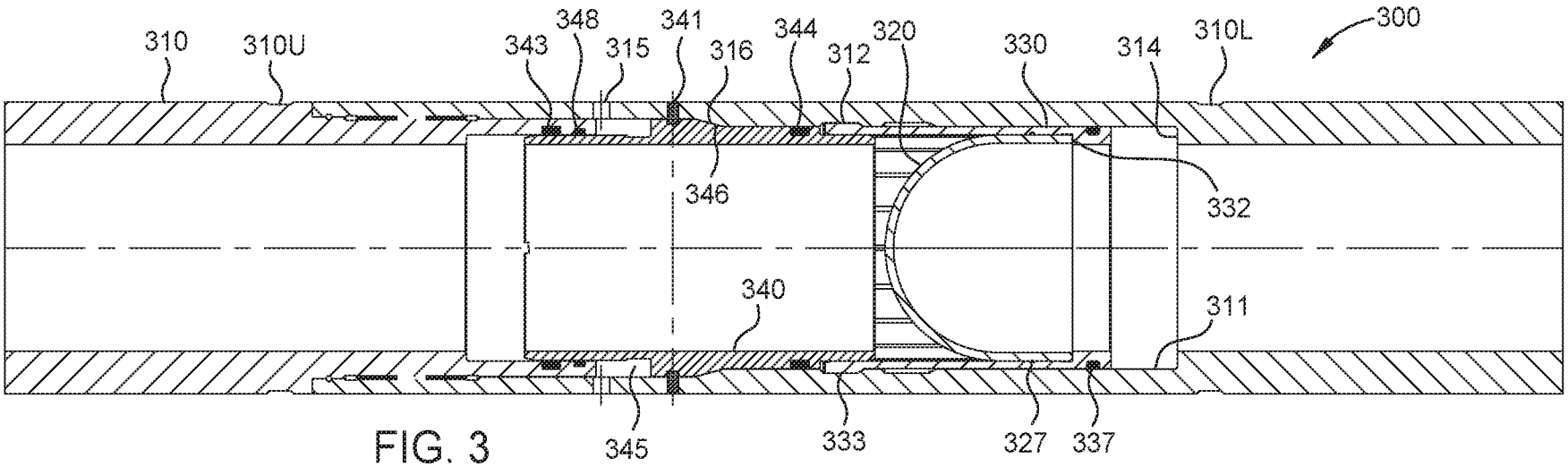
FIG. 3 illustrates an exemplary embodiment of a sealing device.

FIG. 3 illustrates an exemplary embodiment of a sealing device 300. The sealing device 300 is suitable for use as the sealing device 200 in FIG. 1. The sealing device 300 includes a tubular body 310, a frangible sealing element 320, a collet seat 330, and a sleeve 340. The tubular body 310 includes an upper body 310U connected to a lower body 310L. The collet seat 330 is disposed in a recessed portion 311 of the tubular body 310. The collet seat 330 includes a plurality of collet heads 333 disposed at an upper end. The collet heads 333 are engaged with a groove 312 formed in the recessed portion 311. A shoulder 332 is provided at a lower end of the interior surface of the collet seat 330. A sealing member 337 such as a seal ring is disposed between the collet seat 330 and the tubular body 310 to prevent fluid communication therebetween. A gap exists between the bottom of the collet seat 330 and the lower end 314 of the recessed portion 311. When the collet heads 333 are released from the groove 312, the collet seat 330 is movable to contact the lower end 314 of the recessed portion.

A releasable sleeve 340 is provided to retain the collet heads 333 in the groove 312. The sleeve 340 is releasably attached to the tubular body 310 using one or more shearable members 341 such as a shear pin. The lower end of the sleeve 340 is disposed on the interior side of the collet heads 333 to prevent the collet heads 333 from disengaging the groove 312. The upper end of the sleeve 340 has a smaller outer diameter portion that extends across the recessed portion of the tubular body 310. An annular chamber 345 is formed between the upper end of the sleeve 340 and the tubular body 310. An annulus port 315 allows fluid communication between the annular chamber 345 and the exterior of the tubular body 310. A smaller, upper seal ring 343 and a larger, lower seal ring 344 are positioned to prevent fluid communication between the annular chamber 345 and the bore of the tubular body 310. The outer surface of the sleeve 340 includes an optional tapered surface 346 in contact with a complementary tapered surface 316 of the tubular body 310. The tapered surfaces 316, 346 are configured to prevent the downward movement of the sleeve 340. The tapered surfaces 316, 346 also reduce the axial load on the shear pins 341. It must be noted any suitable number of shearable members may be used, for example, from one to twelve shear pins or from two to eight shear pins. The number of shear pins may depend on the desired release pressure for releasing the sleeve 340. In this example, the release pressure is independent of the hydrostatic pressure. Thus, the desired release pressure may be selected by choosing the appropriate number of shear pins. In another embodiment, the manufacturing material of the shear pins provides an additional option to select the release pressure. The material of the shear pins may be changed to increase or decrease the shear force of the pins. Suitable materials for the shear pins include steel, brass, alloys, plastic, and combinations thereof. A switch from brass to steel will increase shear force required to break a shear pin. In one example, the tubular body 310 is pre-drilled with holes for receiving the shear pins. Depending on the desired release pressure, the number of shear pins used may be the same or less than the number of pre-drilled holes. For example, if six holes are pre-formed in the tubular body 310, a shear pin may be disposed in each hole if maximum release pressure is desired.

The frangible sealing element 320 is disposed in the collet seat 330. In one embodiment, the sealing element 320 includes a semispherical dome. The bottom end of the sealing element 320 is supported by the shoulder 332 of the collet seat 330. As shown, the convex surface of the dome is oriented upward toward the rig, and the concave surface of the dome is oriented downward toward the shoe 124 and the valve assembly 130. The sealing element 320 sealingly engages the collet seat 330 to prevent fluid communication between the sealing element 320 and the collet seat 330. For example, a sealing member 327 such as a seal ring is disposed between the collet seat 330 and the sealing element 320 to prevent fluid communication therebetween. The sealing element 320 may be made of a frangible material such as ceramics, metals, glass, porcelains, carbides, and other suitable frangible materials. The convex side of the dome can withstand more pressure than the concave side. For example, the convex side can be rated to withstand a pressure range from 2,000 psi to 13,000 psi, a pressure range from 5,000 psi to 11,500 psi, or a pressure range from 8,000 to 11,000 psi. The concave side can be rated to withstand a pressure range from 300 psi to 5,000 psi, a pressure range from 500 psi to 3,000 psi, or a pressure range from 900 to 1,300 psi. In another example, the sealing element 320 can be configured to withstand a pressure difference from 500 psi to 11,000 psi between the convex side and concave side. In another embodiment, sealing element can withstand a range of ratio of the pressure on the convex side to the pressure on the concave side from 3:1 to 15:1, from 5:1 to 12:1, and from 9:1 to 11:1.

The buoyance chamber 150 may be filled with air instead of liquid to reduce the weight of the casing string 120 in the wellbore 104. In some embodiments, the casing string 120 can be filled with a mixture of air and liquid. In some embodiments, the casing string 120 is filled with a fluid having a lower specific gravity than the fluid in the wellbore 104. Other suitable fluids for filling the casing string 104 include gases such as nitrogen, carbon dioxide, and a noble gas.

In operation, the casing string 120 is run into the wellbore 104 equipped with a buoyant system having a buoyant chamber 150 formed between a valve assembly 130 and a sealing device 300. The buoyant chamber 150 is filled with air to increase the buoyancy effect on the casing string 120, thereby reducing the friction between the casing string 120 and the wall of the wellbore 104. The reduced friction facilitates the run-in of the casing string 120.

Figure 4:
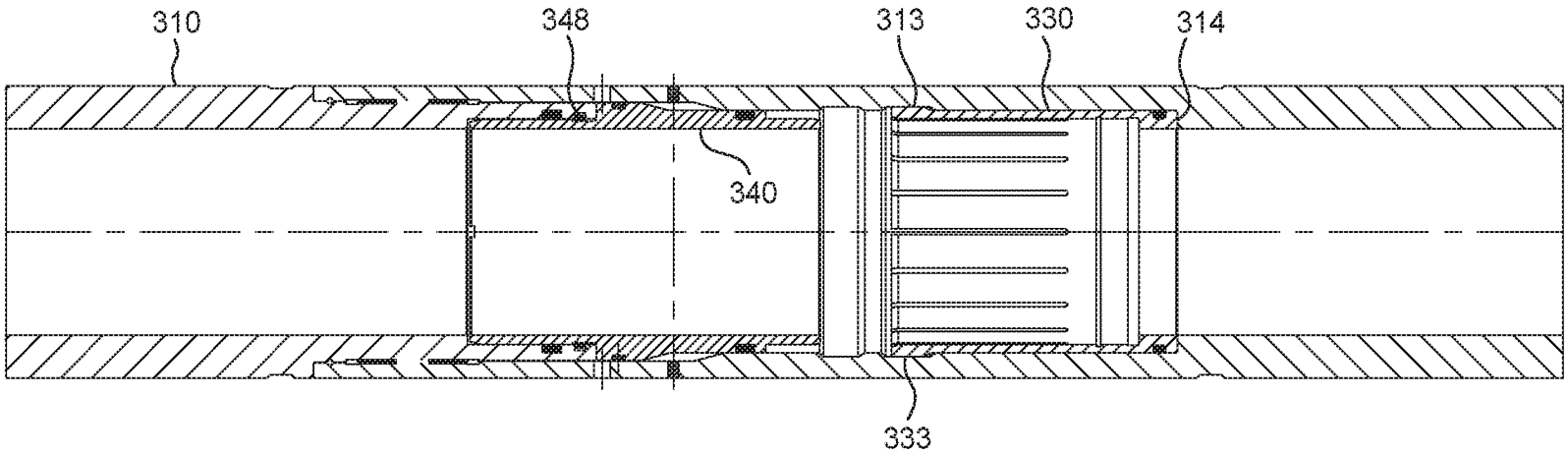
FIG. 4 shows the sealing device of FIG. 3 after the sealing element has been shattered.

After reaching the desired location, pressure above the dome of the sealing element 320 is increased to urge the sleeve 340 to move upward. When sufficient pressure is applied to break the shearable pins 341, the sleeve 340 is moved upward relative to the collet seat 330. It is noted that during run-in, the pressure in the bore of the casing string 120 is approximately the same as the external pressure. Thus, the amount of increased pressure above the dome should be about the same as the differential pressure required for shearing the pins 341. In other words, in this example, the pressure applied to shear the pins 341 is independent of the hydrostatic pressure. After the pins 341 shear, the lower end of the sleeve 340 is moved away from the collet heads 333, thereby freeing the collet heads 333 to disengage from the groove 312. In turn, the collet seat 330 is moved downward, away from the sleeve 340, toward the lower end 314 of the recessed portion 311. The sealing element 320, attached to the collet seat 330, moves downward with the collet seat 330 until the collet seat 320 contacts the lower end 314. The contact force and the pressure above the dome cause the frangible sealing element 320 to break, thereby opening the buoyant chamber 150 for fluid communication. FIG. 4 illustrates the sealing device 300 after the sealing element 320 has been broken. The sleeve 340 has moved upward and may be optionally retained in position using a lock ring 348. The heads 333 of the collet seat 330 are engaged with a lower groove 313. The collet seat 330 has moved downward and rests against the lower end of the tubular body 310. A circulating fluid such as a drilling fluid may fill the buoyant chamber and exit out the shoe 124. Thereafter, a cementing operation is performed to supply cement into the annular area between the casing string 120 and the wellbore 104.

Figure 5:
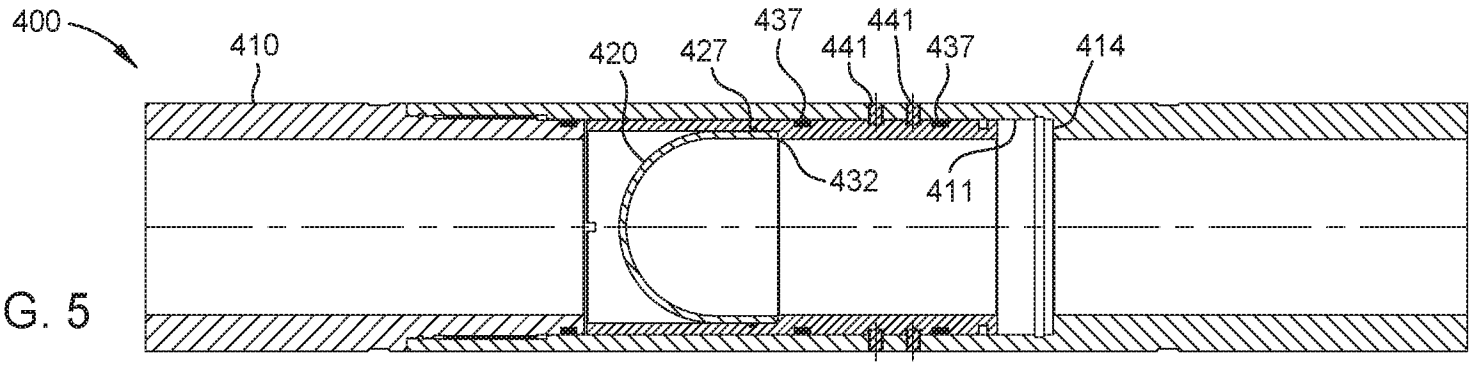
FIG. 5 illustrates another exemplary embodiment of a sealing device.

FIG. 5 illustrates another exemplary embodiment of a sealing device 400. The sealing device 400 is suitable for use as the sealing device 200 in FIG. 1. The sealing device 400 includes a tubular body 410, a frangible sealing element 420, and a movable sleeve 440. The tubular body 410 includes an upper body connected to a lower body. The movable sleeve 440 is disposed in a recessed portion 411 of the tubular body 410.

The movable sleeve 440 is releasably attached to the tubular body 410 using one or more shearable members 441 such as shearable pins. In this embodiment, two rows of shearable pins 441 circumferentially spaced around the sleeve 440 are used to releasably attach the sleeve 440 to the tubular body 410. A gap exists between the bottom of the movable sleeve 440 and the lower end 414 of the recessed portion 411. When the movable sleeve 440 is released from the shear pins 441, the movable sleeve 440 is movable to contact the lower end 414 of the recessed portion 411. A seal ring 437 is disposed on each side of the shear pins 441 to prevent fluid communication between the sleeve 440 and the tubular body 410.

The frangible sealing element 420 is disposed in the movable sleeve 440. In one embodiment, the sealing element 420 includes a semispherical dome. The bottom end of the sealing element 420 is supported by the shoulder 432 of the movable sleeve 440. As shown, the convex surface of the dome is oriented upward toward the rig, and the concave surface of the dome is oriented downward toward the shoe 124. The sealing element 420 sealingly engages the movable sleeve 440 to prevent fluid communication between the sealing element 420 and the movable sleeve 440. For example, a sealing member 437 such as a seal ring is disposed between the movable sleeve 440 and the sealing element 420 to prevent fluid communication therebetween. The sealing element 420 may be made of a frangible material such as ceramics, metals, glass, porcelains, carbides, and other suitable frangible materials. The sealing element 420 may have the same pressure ratings as described above with respect to sealing element 320.

In operation, the casing string 120 is run into the wellbore 104 equipped with a buoyant system having a buoyant chamber 150 formed between a valve assembly 130 and a sealing device 400. The buoyant chamber 150 is filled with air to increase the buoyancy effect on the casing string 120, thereby reducing the friction between the casing string 120 and the wall of the wellbore 104. The reduced friction facilitates the run-in of the casing string 120.

After reaching the desired location, pressure above the dome of the sealing element 420 is increased to urge the sleeve 440 to move downward. When sufficient pressure is applied to break the shearable pins 441, the sleeve 440 is moved downward relative to the tubular body 410. After the pins 441 shear, the lower end of the sleeve 440 moves downward toward the lower end 414 of the recessed portion 411. The sealing element 420, attached to the sleeve 440, moves downward with the sleeve 440 until the sleeve 440 contacts the lower end 414. The contact force and the pressure above dome cause the frangible sealing element 420 to break, thereby opening the buoyant chamber 150 for fluid communication. A circulating fluid such as a drilling fluid may fill the buoyant chamber and exit out the shoe 124. Thereafter, a cementing operation is performed to supply cement into the annular area between the casing string 120 and the wellbore 104.

Figure 6:
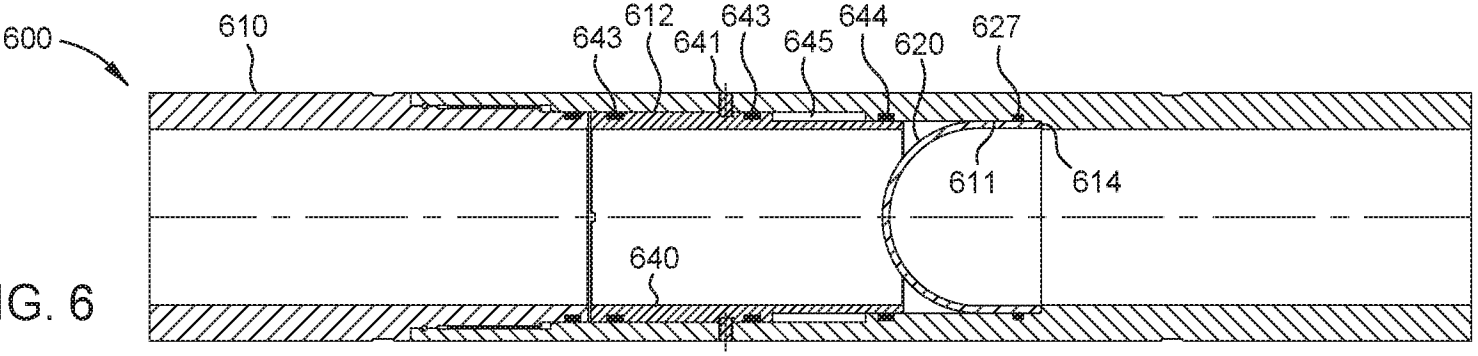
FIG. 6 illustrates another exemplary embodiment of a sealing device.

FIG. 6 illustrates an exemplary embodiment of a sealing device 600. The sealing device 600 is suitable for use as the sealing device 200 in FIG. 1. The sealing device 600 includes a tubular body 610, a frangible sealing element 620, and a sleeve 640. The tubular body 610 includes an upper body connected to a lower body.

The frangible sealing element 620 is disposed in a first recessed portion 611 of the tubular body 610. In one embodiment, the sealing element 620 includes a semispherical dome. The bottom end of the sealing element 620 is supported by the lower end 614 of the recessed portion 611. As shown, the convex surface of the dome is oriented upward toward the rig, and the concave surface of the dome is oriented downward toward the shoe 124. The sealing element 620 sealingly engages the tubular body 610 to prevent fluid communication between the sealing element 620 and the tubular body 610. For example, a sealing member 627 such as a seal ring is disposed between the tubular body 610 and the sealing element 620 to prevent fluid communication therebetween. The sealing element 620 may be made of a frangible material such as ceramics, metals, glass, porcelains, carbides, and other suitable frangible materials. The sealing element 620 may have the same pressure ratings as described above with respect to sealing element 320.

A releasable sleeve 640 is provided to break the sealing element 620. The sleeve 640 is releasably attached to the tubular body 610 using a shearable member 641 such as a shear pin. The sleeve 640 is at least partially disposed in the first recessed portion 611 and a second recessed portion 612 of the tubular body 610. The upper end of the sleeve 640 is in contact with the second recessed portion 612. The lower end of the sleeve 640 has a smaller outer diameter portion that extends across the first recessed portion 611 of the tubular body 610. An annular chamber 645 is formed between the smaller outer diameter portion and the second recessed portion 612. Two larger, upper seal rings 643 and a smaller, lower seal ring 644 are positioned to prevent fluid communication between the annular chamber 645 and the bore of the tubular body 610. The shearable member 641 is disposed between the two upper seal rings 643. The annular chamber 645 is filled with a compressible fluid such as air. A gap exists between the bottom of the sleeve 640 and the sealing element 620. When the sleeve 640 is released from the pins, the sleeve 640 is movable into contact with the sealing element 620.

In operation, the casing string 120 is run into the wellbore 104 equipped with a buoyant system having a buoyant chamber 150 formed between a valve assembly 130 and a sealing device 600. The buoyant chamber 150 is filled with air to increase the buoyancy effect on the casing string 120, thereby reducing the friction between the casing string 120 and the wall of the wellbore 104. The reduced friction facilitates the run-in of the casing string 120.

After reaching the desired location, pressure above the dome of the sealing element 620 is increased to urge the sleeve 640 to move downward. When sufficient pressure is applied to break the shearable pins 641, the sleeve 640 is moved downward relative to the sealing element 620. After the pins 641 shear, the lower end of the sleeve 640 is moved into contact with the sealing element 620. The contact force and the pressure above dome cause the frangible sealing element 620 to break, thereby opening the buoyant chamber 150 for fluid communication. A circulating fluid such as a drilling fluid may fill the buoyant chamber and exit out the shoe 124. Thereafter, a cementing operation is performed to supply cement into the annular area between the casing string 120 and the wellbore 104.

Figure 7:
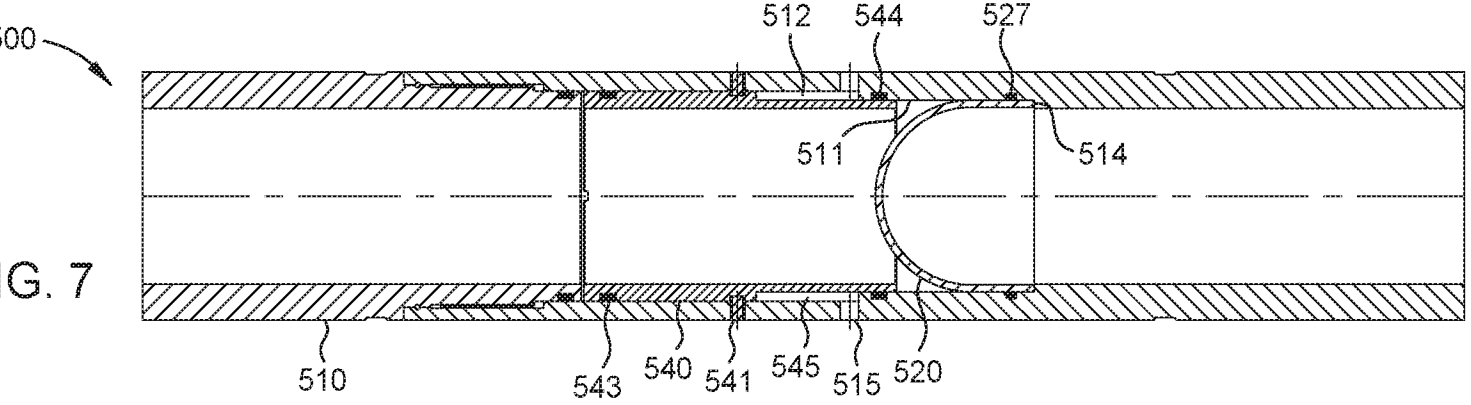
FIG. 7 illustrates another exemplary embodiment of a sealing device.

FIG. 7 illustrates an exemplary embodiment of a sealing device 500. The sealing device 500 is suitable for use as the sealing device 200 in FIG. 1. The sealing device 500 includes a tubular body 510, a frangible sealing element 520, and a sleeve 540. The tubular body 510 includes an upper body connected to a lower body.

The frangible sealing element 520 is disposed in a first recessed portion 511 of the tubular body 510. In one embodiment, the sealing element 520 includes a semispherical dome. The bottom end of the sealing element 520 is supported by the lower end 514 of the recessed portion 511. As shown, the convex surface of the dome is oriented upward toward the rig, and the concave surface of the dome is oriented downward toward the shoe 124. The sealing element 520 sealingly engages the tubular body 510 to prevent fluid communication between the sealing element 520 and the tubular body 510. For example, a sealing member 527 such as a seal ring is disposed between the tubular body 510 and the sealing element 520 to prevent fluid communication therebetween. The sealing element 520 may be made of a frangible material such as ceramics, metals, glass, porcelains, carbides, and other suitable frangible materials. The sealing element 520 may have the same pressure ratings as described above with respect to sealing element 320.

A releasable sleeve 540 is provided to break the sealing element 520. The sleeve 540 is releasably attached to the tubular body 510 using a shearable member 541 such as a shear pin. The sleeve 540 is at least partially disposed in the first recessed portion 511 and a second recessed portion 512 of the tubular body 510. The upper end of the sleeve 540 is in contact with the second recessed portion 512. The lower end of the sleeve 540 has a smaller outer diameter portion that extends across the first recessed portion 511 of the tubular body 510. An annular chamber 545 is formed between the smaller outer diameter portion and the second recessed portion 512. An annulus port 515 allows fluid communication between the annular chamber 545 and the exterior of the tubular body 510. A larger, upper seal ring 543 and a smaller, lower seal ring 544 are positioned to prevent fluid communication between the annular chamber 545 and the bore of the tubular body 510. A gap exists between the bottom of the sleeve 540 and the sealing element 520. When the sleeve 540 is released from the pins, the sleeve 540 is movable into contact with the sealing element 520.

In operation, the casing string 120 is run into the wellbore 104 equipped with a buoyant system having a buoyant chamber 150 formed between a valve assembly 130 and a sealing device 500. The buoyant chamber 150 is filled with air to increase the buoyancy effect on the casing string 120, thereby reducing the friction between the casing string 120 and the wall of the wellbore 104. The reduced friction facilitates the run-in of the casing string 120.

After reaching the desired location, pressure above the dome of the sealing element 520 is increased to urge the sleeve 540 to move downward. When sufficient pressure is applied to break the shearable pin 541, the sleeve 540 is moved downward relative to the sealing element 520. After the pins 541 shear, the lower end of the sleeve 540 is moved into contact with the sealing element 520. The contact force and the pressure above dome cause the frangible sealing element 520 to break, thereby opening the buoyant chamber 150 for fluid communication. A circulating fluid such as a drilling fluid may fill the buoyant chamber and exit out the shoe 124. Thereafter, a cementing operation is performed to supply cement into the annular area between the casing string 120 and the wellbore 104.

Figure 8:
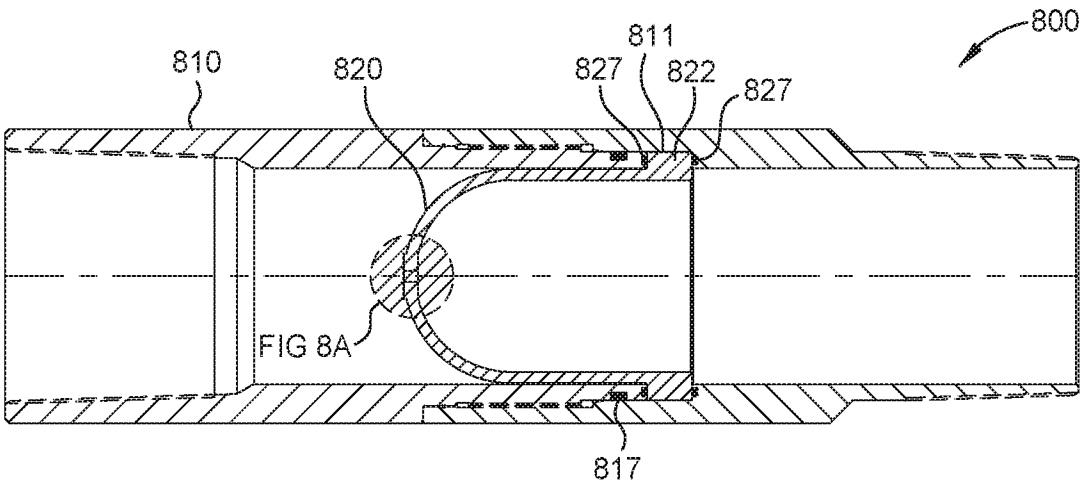
FIG. 8 illustrates another exemplary embodiment of a sealing device.

FIG. 8 illustrates an exemplary embodiment of a sealing device 800. The sealing device 800 is suitable for use as the sealing device 200 in FIG. 1. The sealing device 800 includes a tubular body 810 and a frangible sealing element 820. The tubular body 810 includes an upper body connected to a lower body. A sealing member 817, such as a seal ring, is disposed between the upper body and the lower body to prevent fluid communication therebetween.

The frangible sealing element 820 is disposed in the tubular body 810. In one embodiment, the sealing element 820 includes a semispherical dome. The lower end of the sealing element 820 includes a shoulder 822 that is disposed in a recessed portion 811 of the tubular body 810. As shown, the convex surface of the dome is oriented upward toward the rig, and the concave surface of the dome is oriented downward toward the shoe 124. The sealing element 820 sealingly engages the tubular body 810 to prevent fluid communication between the sealing element 820 and the tubular body 810. For example, sealing members 827 such as a seal ring is disposed between the tubular body 810 and the shoulder of the sealing element 820 to prevent fluid communication therebetween. The sealing element 820 may be made of a frangible material such as ceramics, metals, glass, porcelains, carbides, and other suitable frangible materials. The sealing element 820 may have the same pressure ratings as described above with respect to sealing element 320.

Figure 8C:
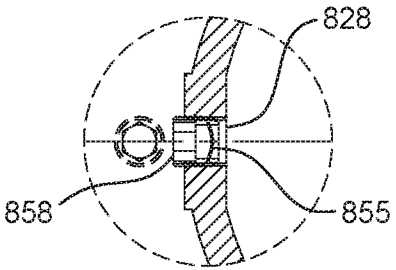
FIG. 8C illustrates another exemplary embodiment of a rupture device.

In one embodiment, the sealing element 820 includes an aperture 828. The aperture 828 is selectively blocked from fluid communication using a rupture device. In the embodiment shown in FIG. 8A, the rupture device is a cover 838 made of a rupturable material. For example, the cover 838 can be a foil made of a material such as titanium, composite material, plastic, and other suitable rupturable material. The cover 838 can be configured to rupture at a selected pressure differential. In one example, the cover 838 is a foil made of titanium having a thickness from 0.01 inches to 0.2 inches and from 0.02 inches to 0.06 inches. The thickness of the cover 838 may depend on the size of the aperture and the selected pressure differential. For example, a thinner cover 838 can be used for a smaller diameter aperture to achieve the same rupture pressure differential. The aperture can have a diameter from 0.1 inches to 0.8 inches; from 0.15 inches to 0.5 inches; and from 0.2 inches to 0.3 inches. In one example, the aperture is 0.25 inches.

Figure 8B:
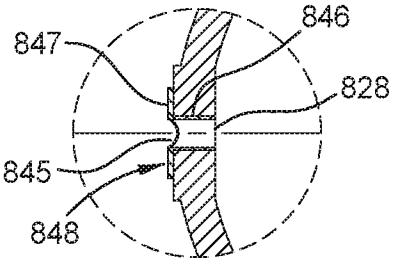
FIG. 8B illustrates another exemplary embodiment of a rupture device.
Figure 8A:
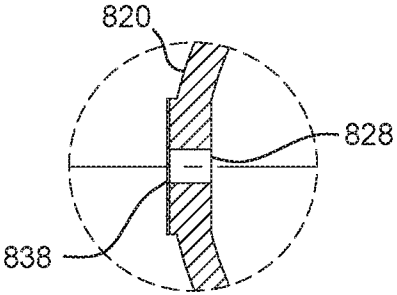
FIG. 8A illustrates an exemplary embodiment of a rupture device.

FIG. 8B illustrates another exemplary rupture device. In this example, the rupture device is an insert 848 having a rupture disk 845. The insert 848 has a tubular body 846 that can line at least a portion of the wall of the aperture 828. The insert 848 can a have a flange 847 that rests against the top surface of the dome. The rupture disk 845 can be configured to rupture at a selected pressure differential.

FIG. 8C illustrates another exemplary rupture device. In this example, the rupture device 858 includes a rupture disk 855 attached to a body having exterior threads that mates with threads in the aperture 828. The rupture disk 855 can be configured to rupture at a selected pressure differential.

In operation, the casing string 120 is run into the wellbore 104 equipped with a buoyant system having a buoyant chamber 150 formed between a valve assembly 130 and a sealing device 800. The buoyant chamber 150 is filled with air to increase the buoyancy effect on the casing string 120, thereby reducing the friction between the casing string 120 and the wall of the wellbore 104. The reduced friction facilitates the run-in of the casing string 120.

After reaching the desired location, pressure above the dome of the sealing element 820 is increased to break the cover 838 over the aperture 828. The cover 838 ruptures when sufficient pressure is applied, thereby opening the aperture 828 for fluid communication. Without being bound by theory, it is believed fluid rushing through the aperture 828 causes cavitation that, in turn, causes the sealing element 820 to shatter. In this manner, the buoyant chamber 150 in the casing string 120 is opened for fluid communication. A circulating fluid such as a drilling fluid may fill the buoyant chamber and exit out the shoe 124. Thereafter, a cementing operation is performed to supply cement into the annular area between the casing string 120 and the wellbore 104.

In another embodiment, a sealing device 900 is disposed at a lower end of the casing string 120, as shown in FIGS. 1 and 2. FIG. 2 is an enlarged partial view of FIG. 1. The sealing device 900 is positioned between the valve assembly 130 and the shoe 124. The sealing device 900 prevents fluid in the wellbore from filling the bore of the casing string 120. The sealing device 900 is configured to withstand the high pressure environment (e.g., 10,000 psi) in the wellbore and protects the valve assembly 130 from the high pressure environment.

Referring to FIG. 2, the sealing device 900 includes a tubular body 910, a plug housing 930, a plurality of arcuate segments 940, and a releasable plug 920. The arcuate segments 940 have dogs 942 formed on an exterior surface that mate with grooves 912 formed in the tubular body 910. In this embodiment, two arcuate segments 940 are used to connect the plug housing 930 to the tubular body 910. The plug housing 930 is disposed in the arcuate segments 940 and prevents the arcuate segments 940 from disengagement with the tubular body 910. A shearable connector 945 such as a snap ring is used to releasably attach the plug housing 930 to the arcuate segments 940. The plug housing 930 includes a shoulder 932 in contact with the tubular body 910. A seal ring 935 is disposed between the shoulder 932 and the tubular body 910 to prevent fluid communication therebetween. In one embodiment, any or all of the components of the sealing device 900 can be made of a dissolvable material, such as an aluminum-based alloy. For example, one or more of the releasable plug 920, the plug housing 930, and the arcuate segments 940 can be made of an aluminum-magnesium alloy.

Figure 9:
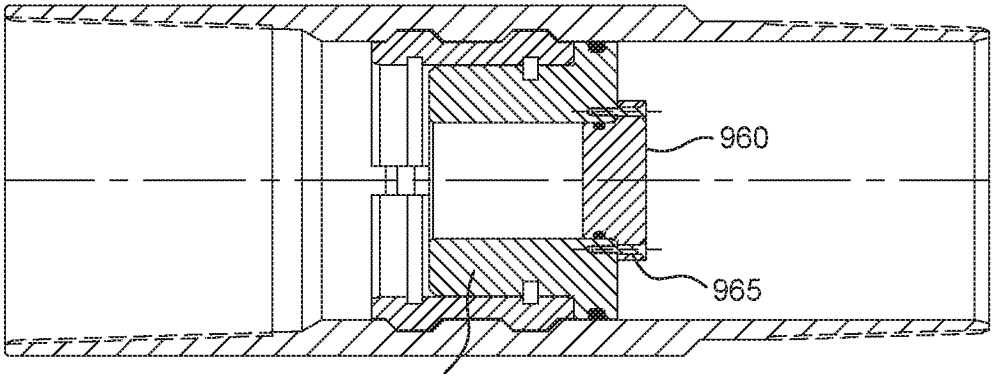
FIG. 9 illustrates another exemplary embodiment of a lower sealing device.

The releasable plug 920 is at least partially disposed in a bore 937 of the plug housing 930. A shearable connector 925 such as a snap ring is used to releasably attach the plug 920 to the plug housing 930. In another embodiment, shear pins 965 are used to releasably attach the plug 960 to the plug housing 930, as shown in FIG. 9. A seal ring 926 is disposed between the plug 920 and the plug housing 930 to prevent fluid communication therebetween. The plug 920 includes a shoulder 922 abutted against the bottom end of the plug housing 930. The shoulder 922 allows the plug 920 to withstand a pressure higher than the shearable connector 925 alone. Thus, a higher pressure is needed to release the plug 920 in the uphole direction than in the downhole direction.

In operation, the casing string 120 is run into the wellbore 104 equipped with a buoyant system having a buoyant chamber 150 formed between a valve assembly 130 and an upper sealing device 300. The casing string 120 includes a lower sealing device 900 disposed between the valve assembly 130 and the shoe 124. The lower sealing device 900 may act as a redundant sealing mechanism for the buoyant chamber 150. The buoyant chamber 150 is filled with air to increase the buoyancy effect on the casing string 120, thereby reducing the friction between the casing string 120 and the wall of the wellbore 104. The reduced friction facilitates the run-in of the casing string 120.

After reaching the desired location, pressure above the dome of the sealing element 320 is increased to shatter the sealing element 320, as previously discussed with respect to FIGS. 3 and 4. After breaking the sealing element 320, fluid is supplied to fill the buoyant chamber 150 and circulate out most of the air. Thereafter, pressure in the casing string 120 is increased until it is sufficient to shear the shearable connection 925 retaining the plug 920. After the plug 920 is released, a fluid such as a drilling fluid may be circulated out of the shoe 124. Thereafter, a cementing operation is performed to supply cement into the annular area between the casing string 120 and the wellbore 104.

Figure 10:
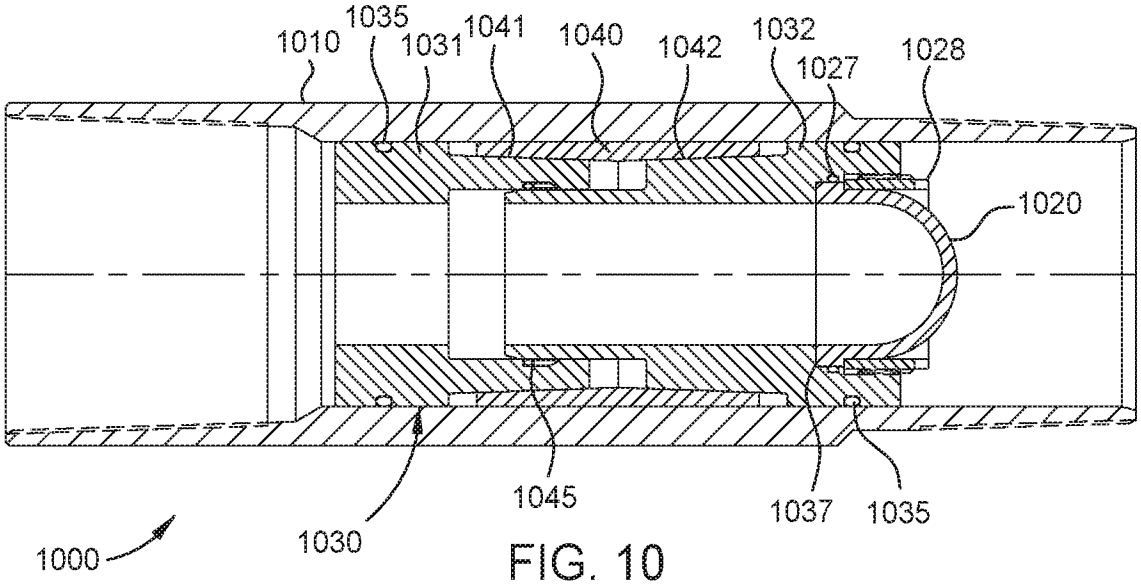
FIG. 10 illustrates another exemplary embodiment of a lower sealing device.
Figure 10A:
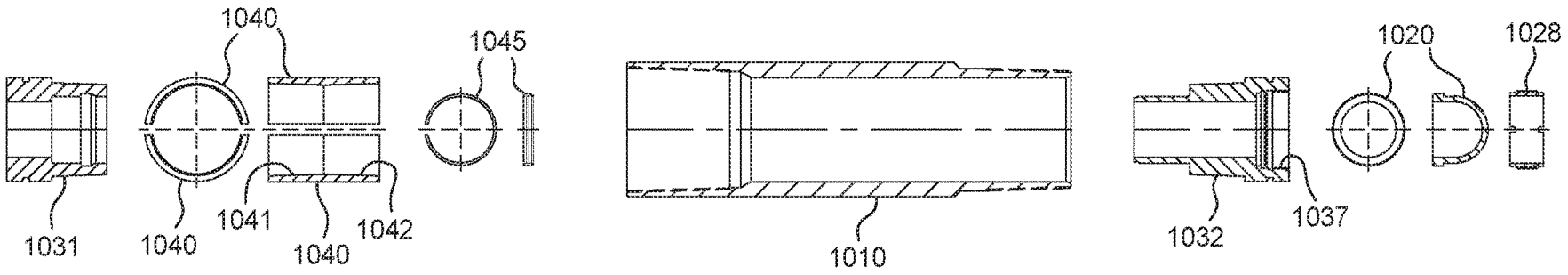
FIG. 10A illustrates the components of the sealing device of FIG. 10.

Another exemplary embodiment of a lower sealing device 1000 is shown in FIGS. 10 and 10A. FIG. 10A is a view of the components of the sealing device 1000. The lower sealing device 1000 is suitable for use as the sealing device 900 of FIG. 1 and can be positioned between the valve assembly 130 and the shoe 124. The sealing device 1000 prevents fluid in the wellbore from filling the bore of the casing string 120. The sealing device 1000 is configured to withstand the high pressure environment (e.g., 10,000 psi) in the wellbore and protects the valve assembly 130 from the high pressure environment.

Referring to FIGS. 10 and 10A, the sealing device in 1000 includes a tubular body 1010, a seal housing 1030, a plurality of arcuate segments 1040, and a sealing element 1020. The seal housing 1030 includes a first housing body 1031 connected to a second housing body 1032. The upper end of the second housing body 1032 is insertable into a bore in the lower end of the first housing body 1031. A shearable connection 1045 such as a snap ring is used to connect the first and second housing bodies 1031, 1032. A seal ring 1035 is disposed between each of the housing bodies 1031, 1032 and the tubular body 1010. The arcuate segments 1040 are disposed in an annular area between the tubular body 1010 and the housing bodies 1031, 1032. In this example, two semicircular arcuate segments 1040 are positioned in the annular area. The upper portion of the inner surface of the arcuate segments 1040 have an inward incline 1041 that mates with a complementary incline of the first housing body 1031, and the lower portion of the inner surface of the arcuate segments 1040 have an outward incline 1042 that mates with a complementary incline of the second housing body 1032. The inward incline 1041 restricts movement of the first housing body 1031 toward the second housing body 1032, and the outward incline 1042 restricts movement of the second housing body 1032 toward the first housing body 1031.

The sealing element 1020 is at least partially disposed in a bore 1037 of the second housing body 1032. In one embodiment, the sealing element 1020 includes a semi-spherical dome. As shown, the concave surface of the dome is oriented upward toward the rig, and the convex surface of the dome is oriented downward toward the shoe 124. The sealing element 1020 sealingly engages the second housing body 1032 to prevent fluid communication between the sealing element 1020 and the housing body 1032. For example, a sealing member 1027 such as a seal ring is disposed between the housing body 1032 and the sealing element 1020 to prevent fluid communication therebetween. The sealing element 1020 is made of a frangible material such as ceramics, metals, glass, porcelains, carbides, and other suitable frangible materials. The sealing element 1020 may have the same pressure ratings as described above with respect to sealing element 320. A retainer sleeve 1028 disposed around the sealing element 1020 is used to retain the sealing element 1020 against the housing body 1032. The retainer sleeve 1028 threadedly connects to the second housing body 1032. In one embodiment, any or all of the components of the sealing device 1000 can be made of a dissolvable material, such as an aluminum-based alloy. For example, one or more of the sealing element 1020, the seal housing 1030, and the arcuate segments 1040 can be made of an aluminum-magnesium alloy.

In operation, the casing string 120 is run into the wellbore 104 equipped with a buoyant system having a buoyant chamber 150 formed between a valve assembly 130 and an upper sealing device 300. The casing string 120 includes a lower sealing device 1000 disposed between the valve assembly 130 and the shoe 124. The lower sealing device 1000 may act as a redundant sealing mechanism for the buoyant chamber 150. The buoyant chamber 150 is filled with air to increase the buoyancy effect on the casing string 120, thereby reducing the friction between the casing string 120 and the wall of the wellbore 104. The reduced friction facilitates the run-in of the casing string 120.

After reaching the desired location, pressure above the dome of the sealing element 320 is increased to shatter the sealing element 320, as previously discussed with respect to FIGS. 3 and 4. After breaking the sealing element 320, fluid is supplied to fill the buoyant chamber 150 and circulate out most of the air. Thereafter, pressure in the casing string 120 is increased until it is sufficient to shatter the sealing element 1020. After breaking the sealing element 1020, a fluid such as a drilling fluid may be circulated out of the shoe 124. Thereafter, a cementing operation is performed to supply cement into the annular area between the casing string 120 and the wellbore 104.

Figure 11:
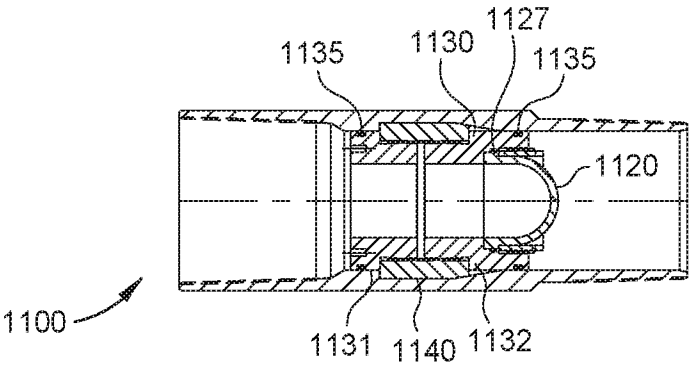
FIG. 11 illustrates another exemplary embodiment of a lower sealing device.
Figure 11A:
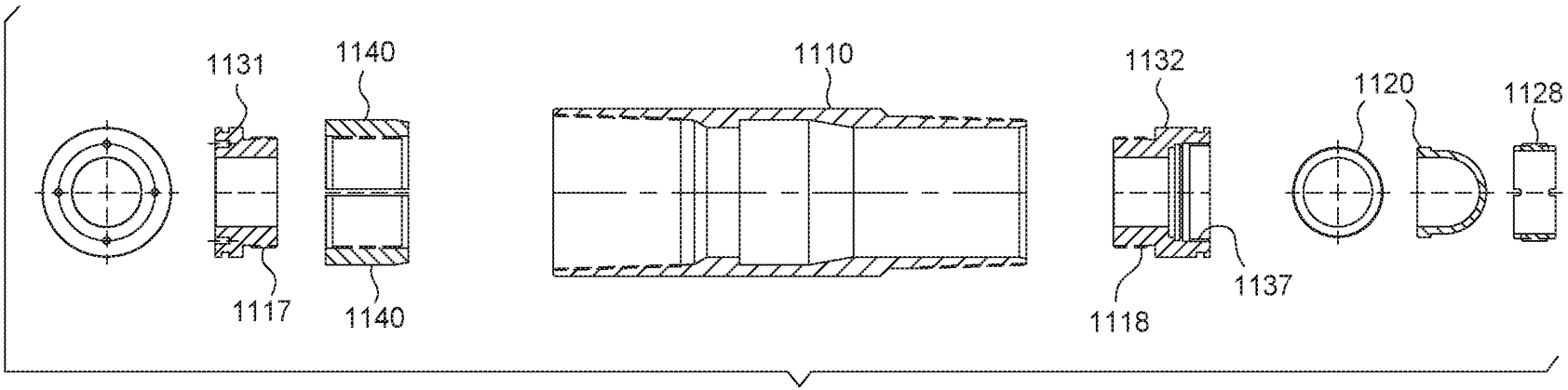
FIG. 11A illustrates the components of the sealing device of FIG. 11.

Another exemplary embodiment of a lower sealing device 1100 is shown in FIGS. 11 and 11A. FIG. 11A is a view of the components of the sealing device 1100. The lower sealing device 1100 is suitable for use as the sealing device 900 of FIG. 1 and can be positioned between the valve assembly 130 and the shoe 124. The sealing device 1100 prevents fluid in the wellbore from filling the bore of the casing string 120. The sealing device 1100 is configured to withstand the high pressure environment (e.g., 10,000 psi) in the wellbore and protects the valve assembly 130 from the high pressure environment.

Referring to FIGS. 11 and 11A, the sealing device in 1100 includes a tubular body 1110, a seal housing 1130, a plurality of arcuate segments 1140, and a sealing element 1120. The seal housing 1130 includes a first housing body 1131 and a second housing body 1132. A seal ring 1135 is disposed between each of the housing bodies 1131, 1132 and the tubular body 1110. The arcuate segments 1140 are disposed in an annular area between the tubular body 1110 and the housing bodies 1131, 1132. In this example, two semicircular arcuate segments 1140 are positioned in the annular area. The annular area may be formed by a recess in the tubular body 1110 and a recess in the housing bodies 1131, 1132. The recess of housing bodies 1131, 1132 includes threads 1117, 1118, respectively, for mating with threads on the arcuate segments 1140.

The sealing element 1120 is at least partially disposed in a bore 1137 of the second housing body 1132. In one embodiment, the sealing element 1120 includes a semi-spherical dome. As shown, the concave surface of the dome is oriented upward toward the rig, and the convex surface of the dome is oriented downward toward the shoe 124. The sealing element 1120 sealingly engages the second housing body 1132 to prevent fluid communication between the sealing element 1120 and the housing body 1132. For example, a sealing member 1127 such as a seal ring is disposed between the housing body 1132 and the sealing element 1120 to prevent fluid communication therebetween. The sealing element 1120 is made of a frangible material such as ceramics, metals, glass, porcelains, carbides, and other suitable frangible materials. The sealing element 1120 may have the same pressure ratings as described above with respect to sealing element 320. A retainer sleeve 1128 disposed around the sealing element 1120 is used to retain the sealing element 1120 against the housing body 1132. The retainer sleeve 1028 threadedly connects to the second housing body 1132. In one embodiment, any or all of the components of the sealing device 1100 can be made of a dissolvable material, such as an aluminum-based alloy. For example, one or more of the releasable plug 1120, the plug housing 1130, and the arcuate segments 1140 can be made of an aluminum-magnesium alloy In operation, the casing string 120 is run into the wellbore 104 equipped with a buoyant system having a buoyant chamber 150 formed between a valve assembly 130 and an upper sealing device 300. The casing string 120 includes a lower sealing device 1100 disposed between the valve assembly 130 and the shoe 124. The lower sealing device 1100 may act as a redundant sealing mechanism for the buoyant chamber 150. The buoyant chamber 150 is filled with air to increase the buoyancy effect on the casing string 120, thereby reducing the friction between the casing string 120 and the wall of the wellbore 104. The reduced friction facilitates the run-in of the casing string 120.

After reaching the desired location, pressure above the dome of the sealing element 320 is increased to shatter the sealing element 320, as previously discussed with respect to FIGS. 3 and 4. After breaking the sealing element 320, fluid is supplied to fill the buoyant chamber 150 and circulate out most of the air. Thereafter, pressure in the casing string 120 is increased until it is sufficient to shatter the sealing element 1120. Thereafter, a fluid such as a drilling fluid may be circulated out of the shoe 124. Thereafter, a cementing operation is performed to supply cement into the annular area between the casing string 120 and the wellbore 104.

Figure 12:
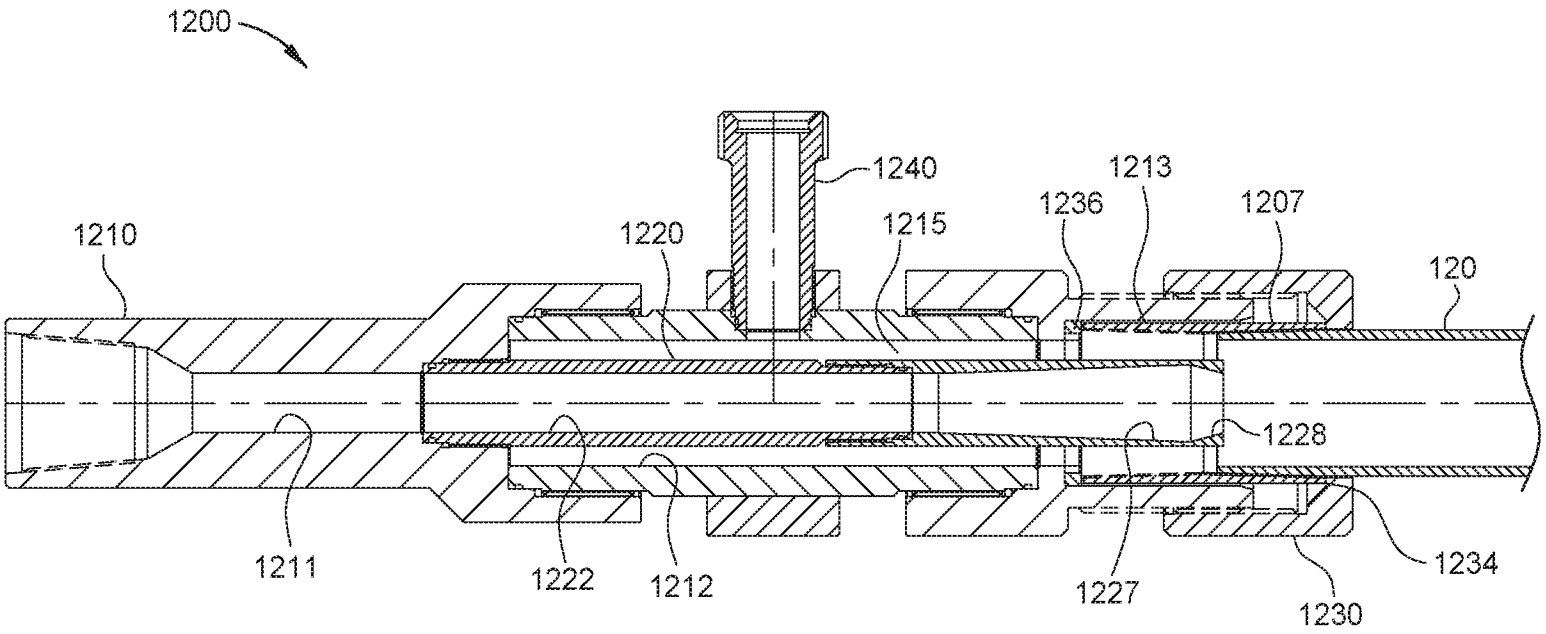
FIG. 12 illustrates an exemplary embodiment of circulation tool.

FIG. 12 illustrates an exemplary embodiment of a circulation tool 1200. The circulation tool 1200 may be used to supply fluid into the buoyant chamber 150 of the casing string 120 and circulate air out of the buoyant chamber 150. The circulation tool 1200 includes a tubular body 1210, an injector tube 1220, a latch 1230, and an air outlet 1240. The tubular body includes a first bore 1201 in fluid communication with a second bore 1212 and a third bore 1213. The second bore 1212 has a larger diameter than the first bore 1211. The third bore 1213 is sufficiently sized to receive an upper end of the casing string 120.

The injector tube 1220 is disposed inside the tubular body 1210 and includes a bore 1220 in fluid communication with the first bore 1211 of the tubular body 1210. An annular area 1215 is formed between the exterior of the injector tube 1220 and the section of the tubular body 1210 containing the second bore 1212 and the third bore 1213. The lower end of the bore 1222 of the injector tube 1220 is configured to choke the fluid flow out of the injector tube 1220. In one embodiment, the bore 1222 initially tapers outward before tapering inward just before the end of the injector tube 1220. In one example, angle of the outward taper 1227 is less than the angle of the inward taper 1228. For example, the outward taper 1227 may be between 1 degree to 10 degrees or between 1 degree and 5 degrees, such as 2 degrees. The inward taper 1228 is between 10 degrees and 20 degrees or between 13 degrees and 17 degrees, such as 15 degrees.

The air outlet 1240 is attached to the tubular body 1210 and is in fluid communication with the annular area 1215. The latch 1230 includes a shoulder 1234 for supporting a bottom end of the coupling 1207 at the upper end of the casing string 120. The latch 1230 may be spring actuated between an engaged position supporting the coupling 1207 and a disengaged position. An optional face seal 1236 is positioned between the upper end of the coupling 1207 and the tubular body 1210. The face seal 1236 may prevent leakage out of the circulation tool 1200.

In operation, the coupling 1207 is inserted into the circulation tool 1200, and the injection tube 1220 is positioned inside the casing string 120. The latch 1230 is actuated to engage and support the coupling 1207. After breaking the sealing element 320, the injector tube 1220 supplies fluid to fill the buoyant chamber 150. Air is circulated out of the casing string 120 and into the annular area 1215 of the circulation tool 1200. The air can exit the circulation tool 1200 via the air outlet 1240. Thereafter, a cementing operation is performed to supply cement into the annular area between the casing string 120 and the wellbore 104.

Figure 13A:
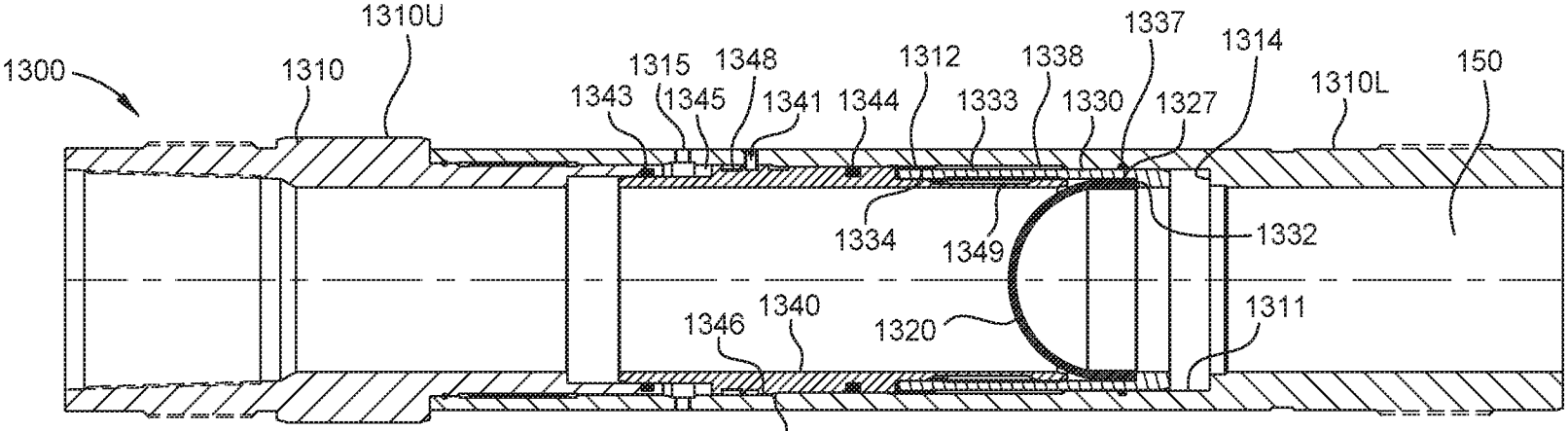
FIGS. 13A-C illustrate another exemplary embodiment of a sealing device.

FIG. 13A illustrates another exemplary embodiment of a sealing device 1300. The sealing device 1300 is suitable for use as the sealing device 200 in FIG. 1. The sealing device 1300 includes a tubular body 1310, a frangible sealing element 1320, a collet seat 1330, and a sleeve 1340. The tubular body 1310 includes an upper body 1310U connected to a lower body 1310L. The collet seat 1330 is disposed in a recessed portion 1311 of the tubular body 1310. The collet seat 1330 includes a plurality of collet fingers 1333 having finger threads 1334 formed on an outer surface. The finger threads 1334 are engaged with body threads 1312 formed on an inner surface of the recessed portion 1311. A shoulder 1332 is provided at a lower end of the interior surface of the collet seat 1330. A sealing member 1337 such as a seal ring is disposed between the collet seat 1330 and the tubular body 1310 to prevent fluid communication therebetween. A gap exists between the bottom of the collet seat 1330 and the lower end 1314 of the recessed portion 1311. When the finger threads 1334 are released from the body threads 1312, the collet seat 1330 is movable across the gap to contact the lower end 1314 of the recessed portion. In one embodiment, a recessed groove 1338 is formed on the inner surface of the recessed portion 1311 to minimize contact of the finger threads 1334 with the tubular body 1310, thereby facilitating movement of the collet seat 1330. In another embodiment, the collet fingers 1333 have a plurality of shoulders formed on an outer surface. The plurality of shoulders is engaged with complementary grooves in the tubular body to axially support the collet seat in the tubular body.

A releasable sleeve 1340 is provided to maintain engagement of the finger threads 1334 with the body threads 1312. The sleeve 1340 is releasably attached to the tubular body 1310 using one or more shearable members 1341 such as a shear pin. The lower end of the sleeve 1340 is disposed on the interior side of the collet fingers 1333 to prevent the finger threads 1334 from disengaging the body threads 1312. The outer surface of the lower end of the sleeve 1340 has a recessed groove 1349 to provide space for finger threads 1334 to disengage from the body threads 1312. The upper end of the sleeve 1340 has a smaller outer diameter portion that extends across the recessed portion of the tubular body 1310 and sealingly contacts an inner surface of the upper body 1310U. An annular chamber 1345 is formed between the upper end of the sleeve 1340 and the tubular body 1310. An annulus port 1315 allows fluid communication between the annular chamber 1345 and the exterior of the tubular body 1310. A smaller, upper seal ring 1343 and a larger, lower seal ring 1344 are positioned to prevent fluid communication between the annular chamber 1345 and the bore of the tubular body 1310. The outer surface of the sleeve 1340 includes an optional tapered surface 1346 in contact with a complementary tapered surface 1316 of the tubular body 1310. The tapered surfaces 1316, 1346 are configured to prevent the downward movement of the sleeve 1340. The tapered surfaces 1316, 1346 also reduce the axial load on the shear pins 1341. It must be noted any suitable number of shearable members may be used, for example, from one to twelve shear pins or from two to eight shear pins. The number of shear pins may depend on the desired release pressure for releasing the sleeve 1340. In this example, the release pressure is independent of the hydrostatic pressure. Thus, the desired release pressure may be selected by choosing the appropriate number of shear pins. In another embodiment, the manufacturing material of the shear pins provides an additional option to select the release pressure. The material of the shear pins may be changed to increase or decrease the shear force of the pins. Suitable materials for the shear pins include steel, brass, alloys, plastic, and combinations thereof. A switch from brass to steel will increase the shear force required to break a shear pin. In one example, the tubular body 1310 is pre-drilled with holes for receiving the shear pins. Depending on the desired release pressure, the number of shear pins used may be the same or less than the number of pre-drilled holes. For example, if six holes are pre-formed in the tubular body 1310, a shear pin may be disposed in each hole if maximum release pressure is desired.

The frangible sealing element 1320 is disposed in the collet seat 1330. In one embodiment, the sealing element 1320 includes a semispherical dome. The bottom end of the sealing element 1320 is supported by the shoulder 1332 of the collet seat 1330. As shown, the convex surface of the dome is oriented upward toward the rig, and the concave surface of the dome is oriented downward toward the shoe 124 and the valve assembly 130. The sealing element 1320 sealingly engages the collet seat 1330 to prevent fluid communication between the sealing element 1320 and the collet seat 1330. For example, a sealing member 1327 such as a seal ring is disposed between the collet seat 1330 and the sealing element 1320 to prevent fluid communication therebetween. The sealing element 1320 may be made of a frangible material such as ceramics, metals, glass, porcelains, carbides, and other suitable frangible materials. The convex side of the dome can withstand more pressure than the concave side. For example, the convex side can be rated to withstand a pressure range from 2,000 psi to 13,000 psi, a pressure range from 5,000 psi to 11,500 psi, or a pressure range from 8,000 to 11,000 psi. The concave side can be rated to withstand a pressure range from 300 psi to 5,000 psi, a pressure range from 500 psi to 3,000 psi, or a pressure range from 900 to 1,300 psi. In another example, the sealing element 1320 can be configured to withstand a pressure difference from 500 psi to 11,000 psi between the convex side and concave side. In another embodiment, sealing element can withstand a range of ratio of the pressure on the convex side to the pressure on the concave side from 3:1 to 15:1, from 5:1 to 12:1, and from 9:1 to 11:1.

In operation, the casing string 120 is run into the wellbore 104 equipped with a buoyant system having a buoyant chamber 150 formed between a valve assembly 130 and a sealing device 1300. The buoyant chamber 150 is filled with air to increase the buoyancy effect on the casing string 120, thereby reducing the friction between the casing string 120 and the wall of the wellbore 104. The reduced friction facilitates the run-in of the casing string 120.

Figure 13B:
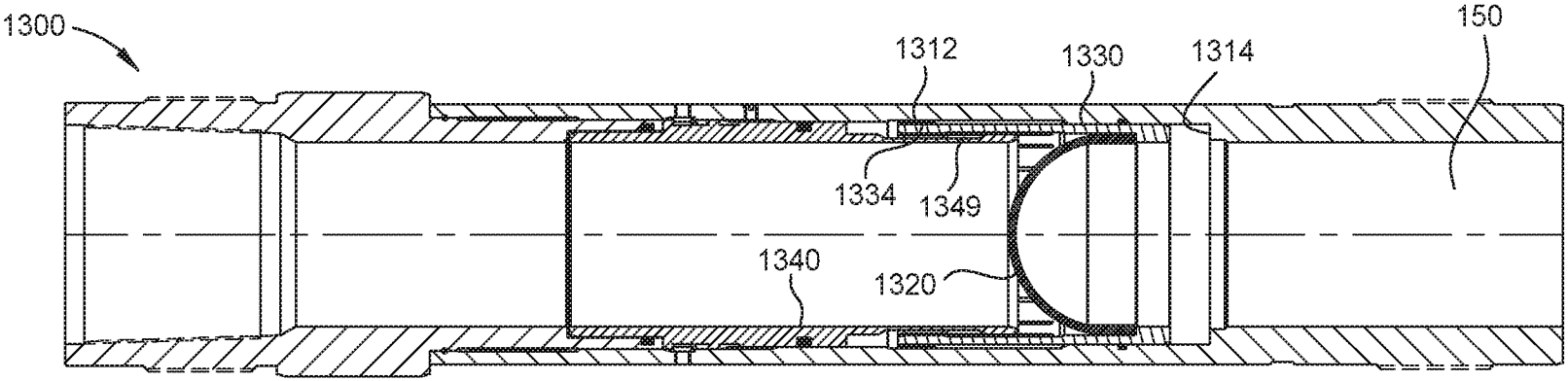
Figure 13C:
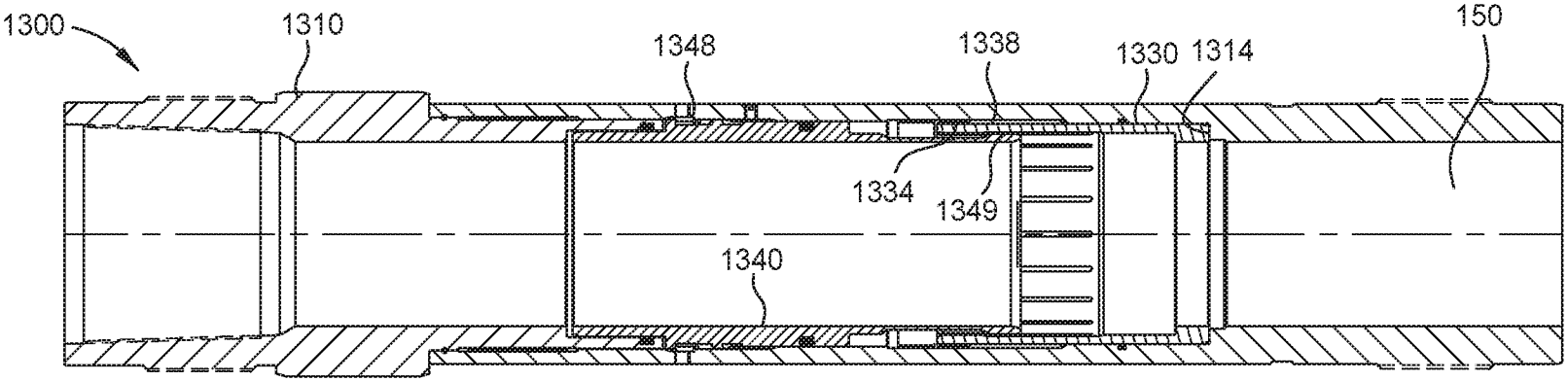

After reaching the desired location, pressure above the dome of the sealing element 1320 is increased to urge the sleeve 1340 to move upward. When sufficient pressure is applied to break the shearable pins 1341, the sleeve 1340 is moved upward relative to the collet seat 1330. It is noted that during run-in, the pressure in the bore of the casing string 120 is approximately the same as the external pressure. Thus, the amount of increased pressure above the dome should be about the same as the differential pressure required for shearing the pins 1341. In other words, in this example, the pressure applied to shear the pins 1341 is independent of the hydrostatic pressure. After the pins 1341 shear, the lower end of the sleeve 1340 is moved away from the collet fingers 1333 due to the difference in size of the seal rings 1343, 1344. In this respect, the finger threads 1334 of the collet fingers 1333 are freed to disengage from the body threads 1312. In turn, the collet seat 1330 moves downward, away from the sleeve 1340, toward the lower end 1314 of the recessed portion 1311. FIG. 13B shows the sleeve 1340 moved upward, and the recessed groove 1349 is located adjacent the finger threads 1334, thereby allowing disengagement from the body threads 1312. The sealing element 1320, coupled to the collet seat 1330, moves downward with the collet seat 1330 until the collet seat 1330 contacts the lower end 1314. The contact force and the pressure above the dome cause the frangible sealing element 1320 to break, thereby opening the buoyant chamber 150 for fluid communication. FIG. 13C illustrates the sealing device 1300 after the sealing element 1320 has been broken. The sleeve 1340 has moved upward and may be optionally retained in position using a lock ring 1348. The finger threads 1334 of the collet seat 1330 are positioned adjacent the recessed groove 1338 of the tubular body 1310. The collet seat 1330 has moved downward and rests against the lower end 1314 of the tubular body 1310. A circulating fluid such as a drilling fluid may fill the buoyant chamber and exit out the shoe 124. Thereafter, a cementing operation is performed to supply cement into the annular area between the casing string 120 and the wellbore 104.

Figure 14A:
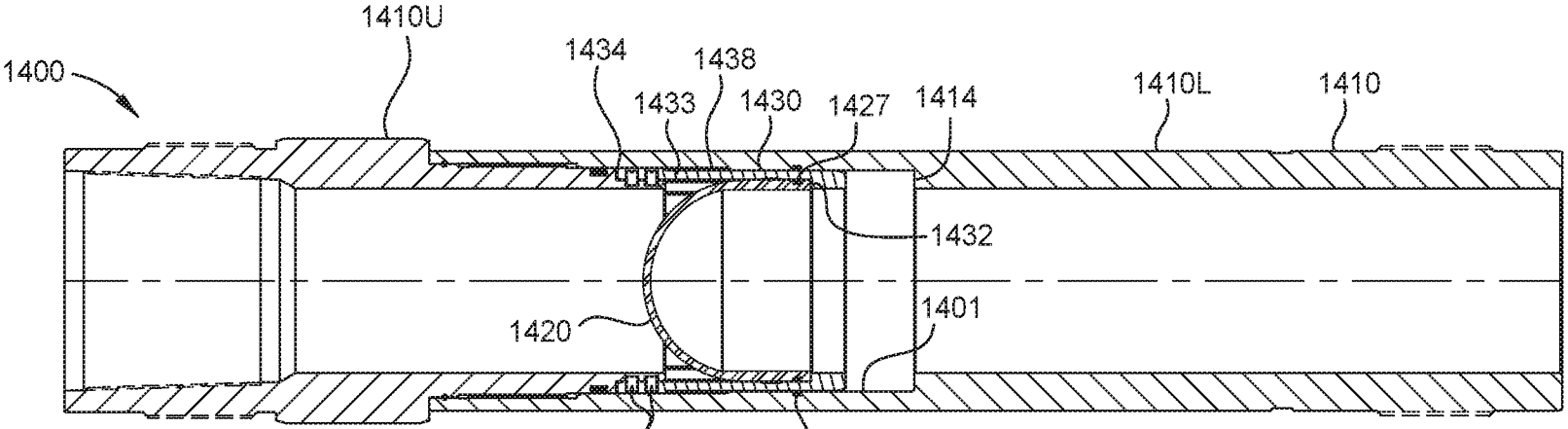
FIGS. 14A-C illustrate yet another exemplary embodiment of a sealing device.
Figure 14B:
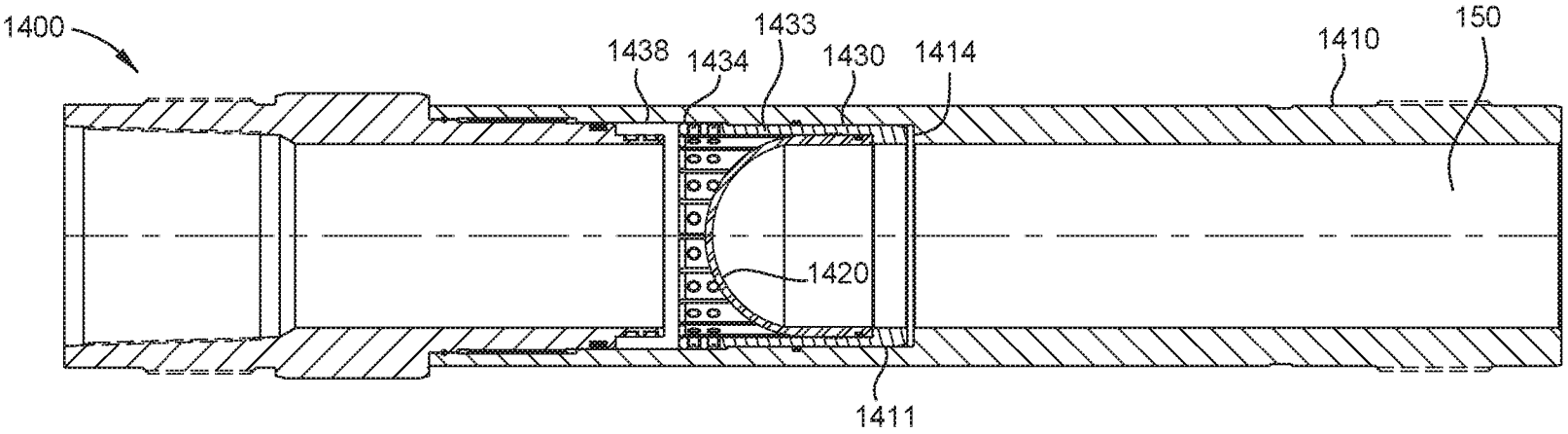

FIG. 14A illustrates another exemplary embodiment of a sealing device 1400. The sealing device 1400 is suitable for use as the sealing device 200 in FIG. 1. The sealing device 1400 includes a tubular body 1410, a frangible sealing element 1420, and a collet seat 1430. The tubular body 1410 includes an upper body 1410U connected to a lower body 1410L. The collet seat 1430 is disposed in a recessed portion 1411 of the tubular body 1410. The collet seat 1430 includes a plurality of collet fingers 1433 having a collet head 1434 formed at an upper end. The collet heads 1434 are disposed between a lower end of the upper body 1410U and a recessed groove 1438 formed on an inner surface of the recessed portion 1411. The inner diameter of the recessed groove 14328 is larger than the inner diameter of the recessed portion 1411. In another embodiment, the collet seat is releasably attached to the groove 1438 of the tubular body 1410.

The collet heads 1434 are releasably attached to the upper body 1410U using one or more shearable members 1441 such as a shear pin. In this embodiment, two shear pins 1441 are used to attach each collet to the upper body 1410U. It must be noted any suitable number of shearable members may be used, for example, from one to 4 shear pins. The number of shear pins may depend on the desired release pressure for releasing the collet seat 1430. In one example, the collet fingers 1433 are pre-drilled with holes for receiving the shear pins. Depending on the desired release pressure, the number of shear pins used may be the same or less than the number of pre-drilled holes. For example, if two holes are pre-formed in each collet finger 1433, some fingers 1433 may receive only one shear pin and others may receive two shear pins.

A shoulder 1432 is provided at a lower end of the interior surface of the collet seat 1430. A sealing member 1437 such as a seal ring is disposed between the collet seat 1430 and the tubular body 1410 to prevent fluid communication therebetween. A gap exists between the bottom of the collet seat 1430 and the lower end 1414 of the recessed portion 1411. When the collet fingers 1433 are released from the upper body 1410U of the tubular body 1410, the collet seat 1430 is movable across the gap to contact the lower end 1414 of the recessed portion.

The frangible sealing element 1420 is disposed in the collet seat 1430. In one embodiment, the sealing element 1420 includes a semispherical dome. The bottom end of the sealing element 1420 is supported by the shoulder 1432 of the collet seat 1430. As shown, the convex surface of the dome is oriented upward toward the rig, and the concave surface of the dome is oriented downward toward the shoe 124 and the valve assembly 130. The sealing element 1420 sealingly engages the collet seat 1430 to prevent fluid communication between the sealing element 1420 and the collet seat 1430. For example, a sealing member 1427 such as a seal ring is disposed between the collet seat 1430 and the sealing element 1420 to prevent fluid communication therebetween. The sealing element 1420 may be made of a frangible material such as ceramics, metals, glass, porcelains, carbides, and other suitable frangible materials. The convex side of the dome can withstand more pressure than the concave side. For example, the convex side can be rated to withstand a pressure range from 2,000 psi to 13,000 psi, a pressure range from 5,000 psi to 11,500 psi, or a pressure range from 8,000 to 11,000 psi. The concave side can be rated to withstand a pressure range from 300 psi to 5,000 psi, a pressure range from 500 psi to 3,000 psi, or a pressure range from 900 to 1,300 psi. In another example, the sealing element 1420 can be configured to withstand a pressure difference from 500 psi to 11,000 psi between the convex side and concave side. In another embodiment, sealing element can withstand a range of ratio of the pressure on the convex side to the pressure on the concave side from 3:1 to 15:1, from 5:1 to 12:1, and from 9:1 to 11:1.

In operation, the casing string 120 is run into the wellbore 104 equipped with a buoyant system having a buoyant chamber 150 formed between a valve assembly 130 and a sealing device 1400. FIG. 14A shows the sealing device 1400 in the run-in position. The buoyant chamber 150 is filled with air to increase the buoyancy effect on the casing string 120, thereby reducing the friction between the casing string 120 and the wall of the wellbore 104. The reduced friction facilitates the run-in of the casing string 120.

After reaching the desired location, pressure above the dome of the sealing element 1420 is increased sufficiently to break the shearable pins 1441. After the pins 1441 shear, the collet seat 1430 is freed to move downward toward the lower end 1414 of the recessed portion 1411. FIG. 13B shows the sealing element 1420, coupled to the collet seat 1430, moved partially downward. The lower end of the collet head 1434 is located at the interface between the recessed groove 1438 and the recessed portion 1411.

Figure 14C:
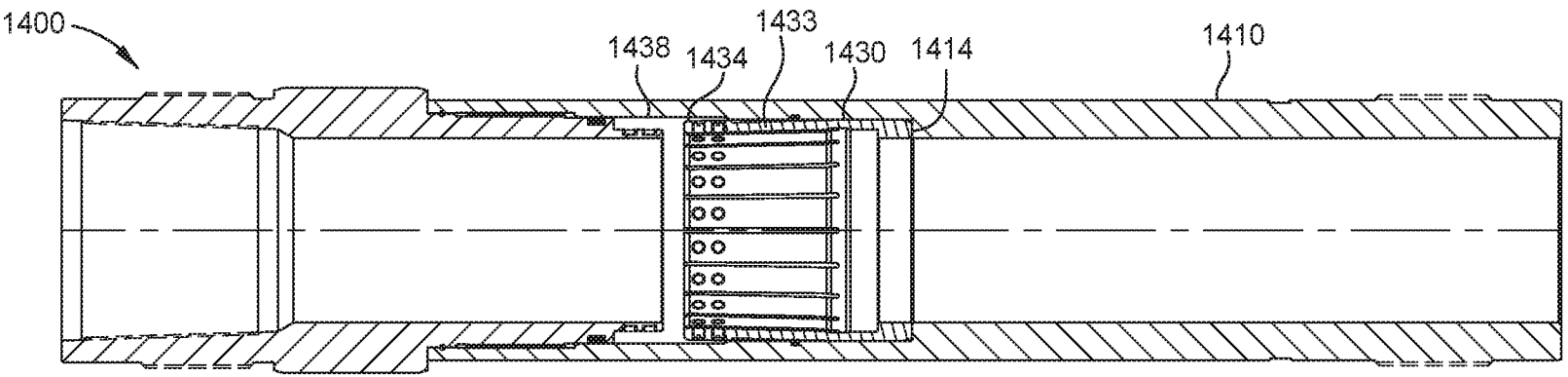

As the collet seat 1430 continues to move downward, the collet fingers 1433 flex inward when the collet heads 1434 travel onto the smaller diameter recessed portion 1411. The collet fingers 1433 apply a compressive force to the sealing element 1420 when the collet fingers 143 flex inward. The compressive force is sufficient to break the frangible sealing element 1420, thereby opening the buoyant chamber 150 for fluid communication. FIG. 14C illustrates the sealing device 1400 after the sealing element 1420 has been broken. The collet fingers 1433 are flexed inward and the collet seat 1430 has moved downward and rests against the lower end 1414 of the tubular body 1410. In the event the sealing element 1420 does not break, the impact force from the collet seat 1430 contacting the lower end 1414 is sufficient to break the sealing element 1420. A circulating fluid such as a drilling fluid may fill the buoyant chamber and exit out the shoe 124. Thereafter, a cementing operation is performed to supply cement into the annular area between the casing string 120 and the wellbore 104.

Figure 15A:
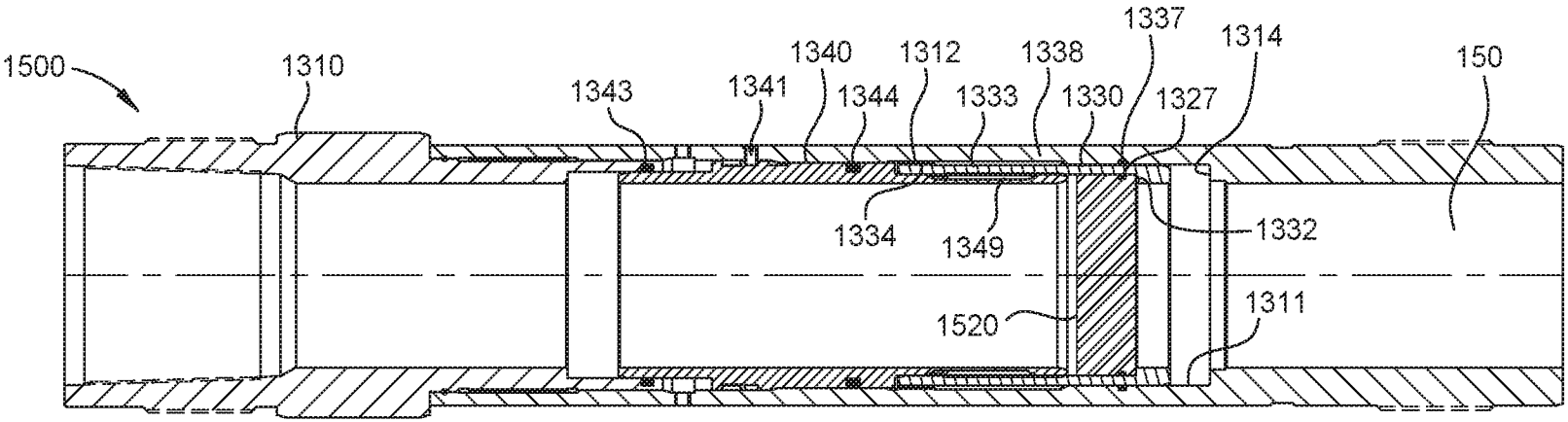
FIGS. 15A-C illustrate yet another exemplary embodiment of a sealing device.

FIG. 15A illustrates another exemplary embodiment of a sealing device 1500. The sealing device 1500 is suitable for use as the sealing device 200 in FIG. 1. The sealing device 1500 is similar to the sealing device 1300 of FIG. 13A, except for the sealing element 1520. In this embodiment, the frangible sealing element 1520 is a rupturable sealing disk instead of a semispherical dome.

As shown in FIG. 15A, the frangible sealing element 1520 is disposed in the collet seat 1330. The bottom end of the sealing element 1520 is supported by the shoulder 1332 of the collet seat 1330. The sealing element 1520 sealingly engages the collet seat 1330 to prevent fluid communication between the sealing element 1520 and the collet seat 1330. For example, a sealing member 1327 such as a seal ring is disposed between the collet seat 1330 and the sealing element 1520 to prevent fluid communication therebetween. The sealing element 1520 may be made of a frangible material such as an aluminum based material. An exemplary aluminum based material is an aluminum-magnesium alloy. The sealing element 1520 made of the aluminum based material is configured to withstand the hydrostatic pressure and break in response to the impact force generated from the collet seat 1330 contacting the lower end 1314 of the tubular body 1310. The thickness of the sealing element 1520 is sufficient to withstand the desired hydrostatic head. In one embodiment, the sealing element 1520 has a thickness between 0.25 inches to 5 inches, between 0.25 inches to 2 inches, or between 0.25 inches to 1 inch. The thickness will also affect the rate of dissolution of the sealing element 1520. In one embodiment, the aluminum based material is optionally dissolvable in a fluid in the wellbore. For example, the aluminum based material is dissolvable in a fluid containing salt, water, and mixtures thereof. In one example, the sealing element 1520 is made of an aluminum-magnesium alloy that is dissolvable in water and potassium chloride. If a dissolvable material is employed, then the sealing disk may optionally be coated with a protective material, such as grease. The protective material will delay or prevent the disk material from dissolving until the disk breaks or after a predetermined time.

In operation, the casing string 120 is run into the wellbore 104 equipped with a buoyant system having a buoyant chamber 150 formed between a valve assembly 130 and a sealing device 1500. The buoyant chamber 150 is filled with air to increase the buoyancy effect on the casing string 120, thereby reducing the friction between the casing string 120 and the wall of the wellbore 104. The reduced friction facilitates the run-in of the casing string 120. The sealing device 1500 is provided with a rupturable sealing disk 1520 made of a material that is dissolvable in the fluid in the wellbore. The sealing disk 1520 is coated with a protective material to prevent the sealing disk 1520 from dissolving prematurely.

Figure 15B:
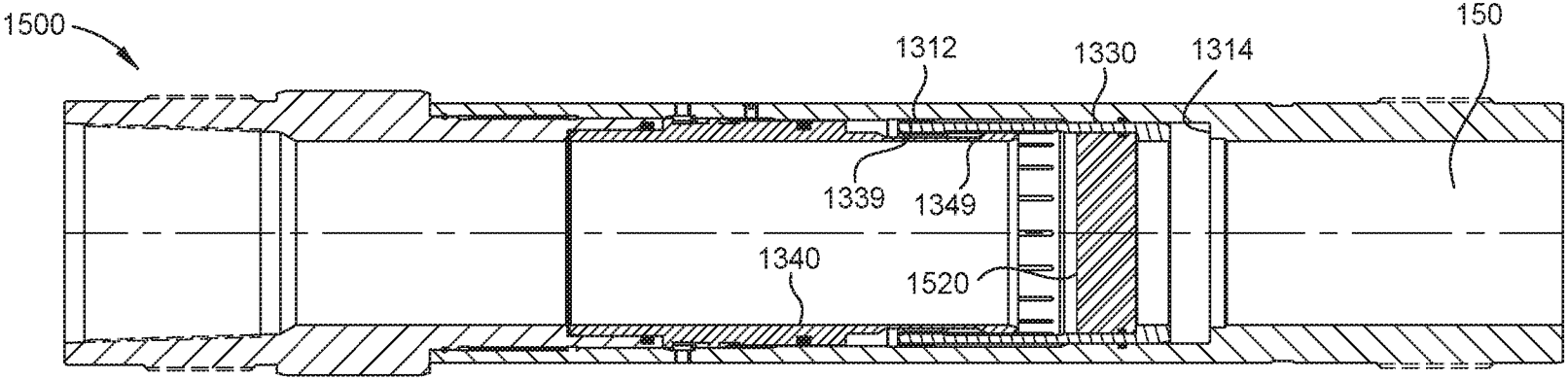
Figure 15C:
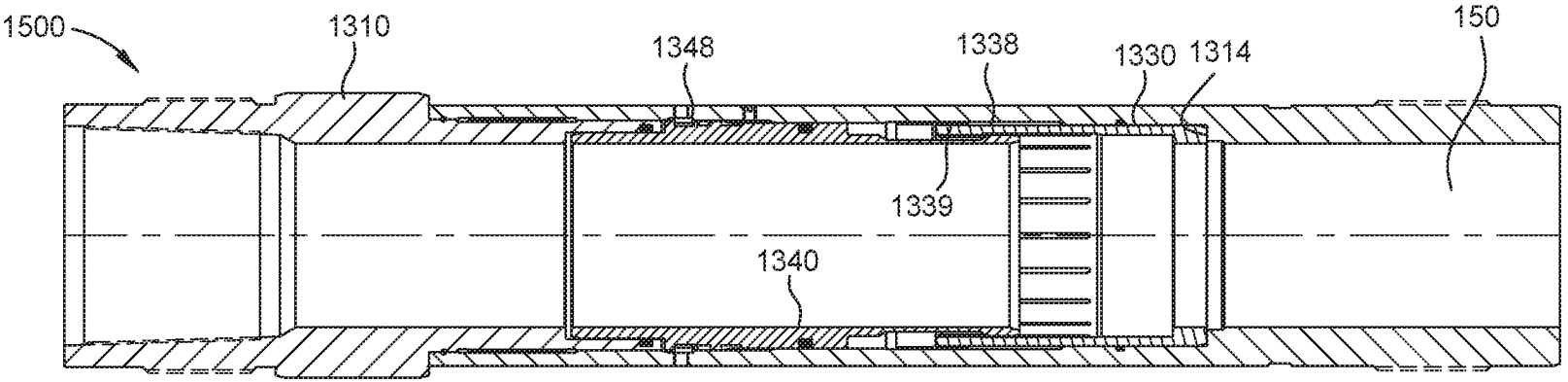

After reaching the desired location, pressure above the dome of the sealing element 1520 is increased to urge the sleeve 1340 to move upward. When sufficient pressure is applied to break the shearable pins 1341, the sleeve 1340 is moved upward relative to the collet seat 1330. It is noted that during run-in, the pressure in the bore of the casing string 120 is approximately the same as the external pressure. Thus, the amount of increased pressure above the dome should be about the same as the differential pressure required for shearing the pins 1341. In other words, in this example, the pressure applied to shear the pins 1341 is independent of the hydrostatic pressure. After the pins 1341 shear, the lower end of the sleeve 1340 is moved away from the collet fingers 1333 due to the difference in size of the seal rings 1343, 1344. In this respect, the finger threads 1334 of the collet fingers 1333 are freed to disengage from the body threads 1312. In turn, the collet seat 1330 moves downward, away from the sleeve 1340, toward the lower end 1314 of the recessed portion 1311. FIG. 15B shows the sleeve 1340 moved upward, and the recessed groove 1349 is located adjacent the finger threads 1334, thereby allowing disengagement from the body threads 1312. The sealing element 1520, coupled to the collet seat 1330, moves downward with the collet seat 1330 until the collet seat 1330 contacts the lower end 1314. The contact force and the pressure above the dome cause the rupturable sealing disk 1520 to break, thereby opening the buoyant chamber 150 for fluid communication. FIG. 15C illustrates the sealing device 1500 after the sealing disk 1520 has been broken. The sleeve 1340 has moved upward and may be optionally retained in position using a lock ring 1348. The finger threads 1334 of the collet seat 1330 are positioned adjacent the recessed groove 1338 of the tubular body 1310. The collet seat 1330 has moved downward and rests against the lower end 1314 of the tubular body 1310. The unprotected surfaces of the broken pieces of the sealing disk are exposed to the wellbore fluid, which cases the broken pieces to dissolve in the wellbore fluid over time. A circulating fluid such as a drilling fluid may fill the buoyant chamber and exit out the shoe 124. Thereafter, a cementing operation is performed to supply cement into the annular area between the casing string 120 and the wellbore 104.

Figure 16:
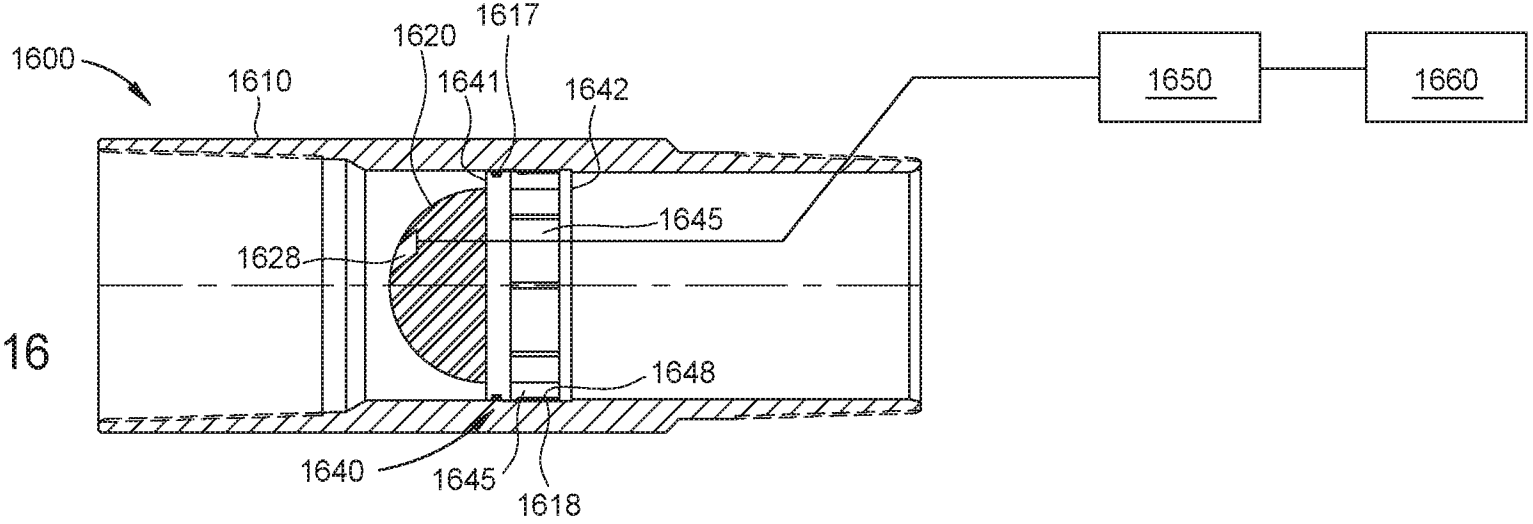
FIG. 16 illustrates yet another exemplary embodiment of a sealing device.

FIG. 16 illustrates an exemplary embodiment of a sealing device 1600. The sealing device 1600 is suitable for use as the sealing device 200 in FIG. 1. The sealing device 1600 includes a tubular body 1610 and a frangible sealing element 1620. The sealing element 1620 is disposed on a support frame 1640 attached to the tubular body 1610. The support frame 1640 includes an upper support ring 1641, a lower support ring 1642, and a plurality of support panels 1645 circumferentially disposed between the upper support ring and the lower support ring. The exterior surface of the support panels 1645 includes threads 1648 for mating with threads 1618 on the tubular body 1610. A sealing member 1617, such as a seal ring, is disposed between the upper support ring 1641 and the tubular body 1610 to prevent fluid communication therebetween.

The frangible sealing element 1620 is disposed on the upper support ring 1641. In one embodiment, the sealing element 1620 includes a semispherical dome. As shown, the convex surface of the dome is oriented upward toward the rig, and the concave surface of the dome is oriented downward toward the shoe 124. The sealing element 1620 sealingly engages the upper support ring 1641 to prevent fluid communication between the sealing element 1620 and the upper support ring 1641. The sealing element 1620 may be made of a frangible material such as ceramics, metals, glass, porcelains, carbides, and other suitable frangible materials. The sealing element 1620 may have the same pressure ratings as described above with respect to sealing element 320. In one embodiment, at least one of the sealing element 1620 and the support frame 1640 is made of a dissolvable material. The dissolvable material may dissolve in the wellbore fluid such as a water and salt mixture.

In one embodiment, the sealing element 1620 includes an aperture 1628 for communicating fluid pressure to a pressure sensor 1650. The pressure sensor 1650 is configured detonate an explosive charge 1660 when a predetermined pressure is detected. The pressure sensor 1650, the charge 1660, and the associated electronics and circuitry may be disposed inside the dome of the sealing element 1620. In another embodiment, the aperture 1628 is formed through the support frame 1640.

In operation, the casing string 120 is run into the wellbore 104 equipped with a buoyant system having a buoyant chamber 150 formed between a valve assembly 130 and a sealing device 1600. The buoyant chamber 150 is filled with air to increase the buoyancy effect on the casing string 120, thereby reducing the friction between the casing string 120 and the wall of the wellbore 104. The reduced friction facilitates the run-in of the casing string 120.

After reaching the desired location, the pressure above the sealing element 1620 is increased. When the predetermined pressure is detected by the sensor 1650, the charge 1660 is detonated to break the sealing element 1620 and the support frame 1640. The detonation breaks the support rings 1641, 1642 into segments, which allows the support panels 1645 to fall away from the threads 1618 of the tubular body 1610. As a result, the buoyant chamber 150 is opened for fluid communication. In one embodiment, the broken sealing element 1620, supporting rings 1641, 1642, and the support panels 1645 may dissolve in the wellbore fluid over time.

[ow 08] In another embodiment, a pressure pulse is used to initiate the collapse of the sealing element 1620. The pressure pulse is transmitted downhole to the sealing element 1720. In one example, the pressure pulse is generated by changing the pressure two or more times. For example, a mud pulse from the surface can be generated by applying a first pressure for a first time period, releasing the first pressure for a second time period, re-applying the first pressure for the first time period, and releasing the first pressure. In one example, a mud pulse from the surface can be generated by applying a pressure of 500 psi for 5 minutes, releasing the pressure for 3 minutes, re-applying a pressure of 500 psi for 5 minutes, and releasing the pressure. When the predetermined pressure pulse is detected by the sensor 1650, the charge 1660 is detonated to break the sealing element 1620 and the support frame 1640.

Figure 17:
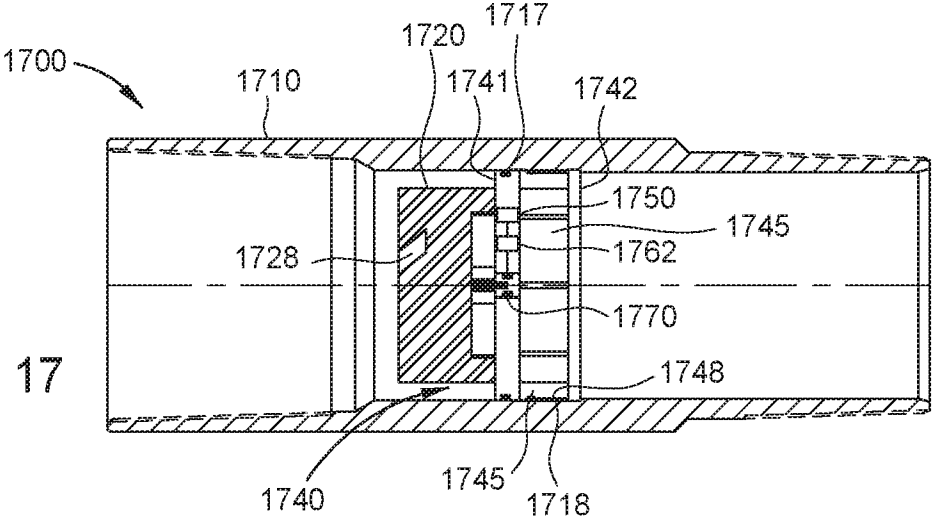
FIG. 17 illustrates yet another exemplary embodiment of a sealing device.

FIG. 17 illustrates an exemplary embodiment of a sealing device 1700. The sealing device 1700 is suitable for use as the sealing device 200 in FIG. 1. The sealing device 1700 includes a tubular body 1710 and a frangible sealing element 1720. The sealing element 1720 is disposed on a support frame 1740 attached to the tubular body 1710. The support frame 1740 includes an upper support ring 1741, a lower support ring 1742, and a plurality of support panels 1745 circumferentially disposed between the upper support ring and the lower support ring. The exterior surface of the support panels 1745 includes threads 1748 for mating with threads 1718 on the tubular body 1710. A sealing member 1717, such as a seal ring, is disposed between the upper support ring 1741 and the tubular body 1710 to prevent fluid communication therebetween. The support frame 1740 is configured to collapse when a release mechanism is activated. An exemplary release mechanism is a chord 1770 that can be burned.

The frangible sealing element 1720 is disposed on the upper support ring 1741. In one embodiment, the sealing element 1720 is a plug. The sealing element 1720 sealingly engages the upper support ring 1741 to prevent fluid communication between the sealing element 1720 and the upper support ring 1741. The sealing element 1720 may be made of aluminum, mild steel, brass, and combinations thereof. An optional o-ring may be disposed between the sealing element 1720 and the upper support ring 1741. In one embodiment, at least one of the sealing element 1720 and the support frame 1740 is made of a dissolvable material. The dissolvable material may dissolve in the wellbore fluid such as a water and salt mixture.

In one embodiment, the sealing element 1720 includes an aperture 1728 for communicating fluid pressure to a pressure sensor 1750. The pressure sensor 1750 is configured to activate a battery 1762 to heat up a wire when a predetermined pressure is detected. After sufficient heating, the wire will burn a chord 1770, thereby collapsing the upper support ring 1741 and the lower support ring 1742. The pressure sensor 1750, the battery 1762, the chord 1770, and any associated electronics and circuitry may be disposed inside or under the sealing element 1720. In another embodiment, the aperture 1728 is formed through the support frame 1740.

In operation, the casing string 120 is run into the wellbore 104 equipped with a buoyant system having a buoyant chamber 150 formed between a valve assembly 130 and a sealing device 1700. The buoyant chamber 150 is filled with air to increase the buoyancy effect on the casing string 120, thereby reducing the friction between the casing string 120 and the wall of the wellbore 104. The reduced friction facilitates the run-in of the casing string 120.

After reaching the desired location, the pressure above the sealing element 1720 is increased. When the predetermined pressure is detected by the sensor 1750, the battery 1750 is activated to heat the wire 1770. After sufficient heating, the wire 1770 will burn, thereby collapsing the support frame 1740. Collapse of the support rings 1741, 1742 allows the support panels 1745 to fall away from the threads 1718 of the tubular body 1710 and releases the sealing element 1720. As a result, the buoyant chamber 150 is opened for fluid communication. In one embodiment, the sealing element 1720, supporting rings 1741, 1742, and the support panels 1745 may dissolve in the wellbore fluid over time. In another embodiment, the batter 1750 is activated when the sensor 1750 detected a predetermined pressure pulse.

In one embodiment, a sealing device includes a tubular body having a bore; a collet seat having a plurality of collets; a frangible sealing element disposed in the collet seat and blocking fluid communication through the bore; and a releasable sleeve releasably attached to the tubular body and retaining the collet seat against the tubular body.

In another embodiment, a sealing device includes a tubular body having a bore; a collet seat having a plurality of collets; a frangible sealing element disposed in the collet seat and blocking fluid communication through the bore; and a releasable sleeve releasably attached to the tubular body, wherein the plurality of collets is attached to the sleeve.

In one or more embodiments described herein, the collet seat is in a first position when retained by the sleeve, and wherein the collet seat is movable to a second position when released from the sleeve.

In one or more embodiments described herein, the sealing element breaks with the collet seat reaches the second position.

In one or more embodiments described herein, the collet seat contacts a shoulder in the tubular body when the collet seat reaches the second position.

In one or more embodiments described herein, the second position of the sleeve is located higher than the first position relative to the groove.

In one or more embodiments described herein, an annular chamber is formed between the sleeve and the tubular body.

In one or more embodiments described herein, the device includes a port for fluid communication between the annular chamber and an exterior of the tubular body.

In one or more embodiments described herein, the sealing element includes a frangible material selected from the group consisting of ceramics, metals, glass, porcelains, carbides, and combinations thereof.

In one or more embodiments described herein, each collet includes a collet head engaged with a groove formed in the tubular body.

In one or more embodiments described herein, the releasable sleeve, in a first position, prevents the collet head from disengaging from the groove, and, in a second position, allows the collet head from disengaging from the groove.

In one or more embodiments described herein, the sealing element comprises a dome.

In one or more of the embodiments described herein, the plurality of the collets includes threads mated with threads on the tubular body.

In one or more of the embodiments described herein, a lower end of the sleeve includes a recessed groove.

In one or more of the embodiments described herein, the plurality of collets is attached to the sleeve.

In one or more of the embodiments described herein, the plurality of collets is attached to the sleeve using one or more shear pins.

In one or more of the embodiments described herein, the sealing element comprises a disk.

In one or more of the embodiments described herein, the sealing element comprises a dissolvable material.

In one or more of the embodiments described herein, the dissolvable material comprises an aluminum-based alloy.

In another embodiment, a sealing device includes a tubular body having a bore; a frangible sealing element disposed in the tubular body and blocking fluid communication through the bore; an aperture formed in the sealing element; and a rupture device selectively blocking fluid communication through the aperture.

In one or more embodiments described herein, the rupture device includes a foil cover.

In one or more embodiments described herein, the rupture device includes an insert having a rupture disk or a threaded body having a rupture disk.

In one or more embodiments described herein, the sealing element shatters in response to fluid flowing through the aperture.

In another embodiment, a tubular assembly disposed in a wellbore, includes a tubular string having a bore; a sealing device as described herein disposed in the tubular string and blocking fluid flow through the bore; a valve assembly disposed in the tubular string and downstream from the sealing device, the valve assembly blocking fluid flow through the bore; a buoyant chamber formed between the sealing device and the valve assembly, the buoyant chamber including a fluid having a lower specific gravity than a fluid in the wellbore.

In one or more embodiments described herein, the sealing element includes a dome, and a convex surface of the dome is oriented upward, and the concave surface of the dome is oriented downward toward the valve assembly.

In one or more embodiments described herein, the tubular assembly includes a circulation tool having an injection tube with a tapered bore.

In another embodiment, a tubular assembly disposed in a wellbore includes a tubular string having a bore; a lower sealing device disposed in the tubular string and blocking fluid flow through the bore; an upper sealing device disposed in the tubular string and located upstream from the lower sealing device, the upper sealing device blocking fluid flow through the bore.

In one embodiment, the upper sealing device includes a tubular body having a bore; a frangible sealing element disposed in the tubular body and blocking fluid communication through the bore of the tubular body, the sealing element includes a dome having a concave surface oriented toward the lower sealing device; and a buoyant chamber formed between the lower sealing device and a upper sealing device, the buoyant chamber including a fluid having a lower specific gravity than a fluid in the wellbore.

In one or more embodiments described herein, the upper sealing device includes an aperture formed through the dome; and a rupture device selectively blocking fluid communication through the aperture.

In one or more embodiments described herein, the sealing element of the upper sealing device is seated in a collet seat releasably attached to the tubular body.

In one or more embodiments described herein, the collet seat is movable into contact with a portion of the tubular body to cause the sealing element to shatter.

In one or more embodiments described herein, the lower sealing device includes a tubular body having a bore; a plug housing coupled to the tubular body; a plug releasably attached to the plug housing and blocking fluid flow through the plug housing.

In one or more embodiments described herein, the tubular assembly includes a valve assembly disposed between the upper sealing device and the lower sealing device.

In one or more embodiments described herein, the lower sealing device includes a tubular body having a bore; and a frangible sealing element disposed in the tubular body and blocking fluid communication through the bore of the tubular body, the sealing element includes a dome having a concave surface oriented toward the upper sealing device.

In another embodiment, a method of installing a tubular string in a wellbore includes forming a buoyant chamber between a sealing device and a valve assembly disposed in the tubular string. The sealing device includes a tubular body having a bore; a frangible sealing element disposed in the tubular body and blocking fluid communication through the bore of the tubular body, the sealing element includes a dome and an aperture formed through the dome; and an aperture formed through the dome, the aperture blocked from fluid communication. The method also includes supplying the buoyant chamber with a fluid having a lower specific gravity than a fluid in the wellbore; moving the tubular string along the wellbore; applying pressure to open the aperture for fluid communication; and flowing fluid through the aperture to break the sealing element.

In one or more embodiments described herein, the method includes circulating at least a portion of the lower specific gravity fluid out of the buoyant chamber.

In one or more embodiments described herein, the method includes blocking fluid communication through the tubular string by installing a lower sealing device at a location downstream from the valve assembly.

In one or more embodiments described herein, the method includes supplying pressure to open the lower sealing device for fluid communication after circulating at least the portion of the lower specific gravity fluid out of the buoyant chamber.

In one or more embodiments described herein, the lower sealing device is one of a frangible sealing element and a releasable plug.

In one or more embodiments described herein, the method includes supplying cement through the valve assembly.

In another embodiment, a sealing device includes a tubular body having a bore; a frangible sealing element disposed in the tubular body and blocking fluid communication through the bore; an aperture formed in the sealing element; and a rupture device selectively blocking fluid communication through the aperture.

In one or more of the embodiments described herein, the rupture device comprises a foil cover.

In one or more of the embodiments described herein, the rupture device comprises an insert having a rupture disk or a threaded body having a rupture disk.

In one or more of the embodiments described herein, sealing element shatters in response to fluid flowing through the aperture.

In another embodiment, a sealing device includes a tubular body having a bore; a support frame attached to the tubular body; a sealing element disposed on the support frame and blocking fluid communication through the bore; and a sensor configured to detect a pressure exterior of the sealing element, wherein the support frame is configured to collapse in response to the sensor detecting a predetermined pressure or pressure pulse.

In one or more of the embodiments described herein, the sealing device includes an explosive charge, wherein the explosive charge is detonated upon detecting the predetermined pressure or pressure pulse.

In one or more of the embodiments described herein, the sealing element comprises a frangible dome.

In one or more of the embodiments described herein, the sealing device includes a battery and a wire, wherein the battery causes the wire to burn upon detecting the predetermined pressure or pressure pulse.

In one or more of the embodiments described herein, the sealing element comprises a dissolvable plug.

In one or more of the embodiments described herein, the support frame includes an upper support ring; a lower support ring; and a plurality of support panels disposed between the upper support ring and the lower support ring.

In one or more of the embodiments described herein, the plurality of support panels includes threads for connection with the tubular body.

In one or more of the embodiments described herein, the sealing element includes an aperture for communicating pressure to the sensor.

In one or more of the embodiments described herein, the lower sealing device comprises a dissolvable material.

In one or more of the embodiments described herein, the valve arrangement comprises a dissolvable material.

While the foregoing is directed to embodiments of the present disclosure, other and further embodiments of the disclosure may be devised without departing from the basic scope thereof, and the scope thereof is determined by the claims that follow.

The invention claimed is:

1. A sealing device, comprising:

a tubular body having a bore and threads;

a collet seat having a plurality of collets and moveable from a first position to a second position, wherein the plurality of the collets includes threads mated with the threads of the tubular body in the first position, wherein the threads of the plurality of collets are disengaged with the threads of the tubular body in the second position;

a frangible sealing element disposed in the collet seat and blocking fluid communication through the bore, wherein the collet seat is moveable from the first position to the second position in response to a fluid pressure acting on the frangible sealing element; and a releasable sleeve releasably attached to the tubular body and configured to retain the collet seat in the first position.

2. The device of claim 1, wherein the collet seat is movable to a second position when released from the sleeve.

3. The device of claim 2, wherein the sealing element breaks when the collet seat reaches the second position.

4. The device of claim 3, wherein the collet seat contacts a shoulder in the tubular body when the collet seat reaches the second position.

5. The device of claim 1, wherein the sealing element comprises a dome or a disk.

6. The device of claim 1, wherein a lower end of the sleeve includes a recessed groove.

7. The device of claim 1, wherein the sleeve moves away from the collet seat in response to a fluid pressure when the sleeve is released from the tubular body.

8. The device of claim 1, further comprising an annular chamber formed between the sleeve and the tubular body.

9. The device of claim 8, further comprising a port for fluid communication between the annular chamber and an exterior of the tubular body.

10. The device of claim 1, wherein the sealing element comprises a frangible material selected from the group consisting of ceramics, metals, glass, porcelains, carbides, and combinations thereof.

11. The device of claim 1, wherein each collet includes a collet head engaged with a groove formed in the tubular body.

12. The device of claim 11, wherein the releasable sleeve, in a first position, prevents the collet head from disengaging from the groove, and, in a second position, allows the collet head to disengage from the groove.

13. A tubular assembly disposed in a wellbore, comprising:

a tubular string having a central bore, wherein the tubular string includes a sealing device of claim 1 blocking fluid flow through the bore, wherein the central bore includes the bore of the tubular body;

a valve assembly disposed in the tubular string and downstream from the sealing device, the valve assembly blocking fluid flow through the central bore; and a buoyant chamber formed between the sealing device and the valve assembly, the buoyant chamber including a fluid having a lower specific gravity than a fluid in the wellbore.

14. The tubular assembly of claim 13, wherein the sealing element of claim 1 comprises a dome, wherein a convex surface of the dome is oriented upward, and a concave surface of the dome is oriented downward toward the valve assembly.

15. The tubular assembly of claim 14, further comprising a circulation tool having an injection tube with a tapered bore.

16. A sealing device, comprising:

a tubular body having a bore and a shoulder;

a collet seat disposed within the tubular body and axially moveable from a first position to a second position, wherein an end of the collet seat contacts the shoulder when the collet seat is in the second position;

a frangible sealing element configured to block the bore when the collet seat is in the first position, wherein the frangible sealing element is configured to move with the collet seat and configured to break in response to an impact force caused by the collet seat contacting the shoulder when the collet seat reaches the second position;

a sleeve configured to maintain the collet seat in the first position, wherein the sleeve is moveable to allow the collet seat to move to the second position.

17. The device of claim 16, wherein the sealing element comprises a disk having an aluminum based material configured to dissolve.

18. A sealing device, comprising:

a tubular body having a bore, a recessed portion, and threads;

a collet seat disposed in the recessed portion and having a plurality of collets, the plurality of the collets includes threads, wherein the collet seat is moveable from a first position to a second position, wherein:

when in the first position, the threads of the plurality of collets are engaged with the threads of the tubular body; and when in the second position, the collet seat contacts a lower end of the recessed portion and the threads of the plurality of collets are disengaged with the threads of the tubular body;

a frangible sealing element disposed in the collet seat, wherein the frangible sealing element blocks fluid communication through the bore when the collet seat is in the first position; and a releasable sleeve moveable from a first position to a second position, wherein the releasable sleeve is attached to the tubular body and retains the collet seat in the first position.

19. The device of claim 18, wherein the sealing element breaks when the collet seat reaches the second position.

20. The device of claim 18, wherein the sealing element comprises a dome or a disk.

* * * * *